US010774519B2

(12) United States Patent
Tucker

(10) Patent No.: US 10,774,519 B2
(45) Date of Patent: Sep. 15, 2020

(54) FORTIFIED RADIAL ARCH STRUCTURE

(71) Applicant: Jack M. Tucker, Scappose, OR (US)

(72) Inventor: Jack M. Tucker, Scappose, OR (US)

(73) Assignee: RAM STRUCTURES LLC, Scappoose, OR (US)

( * ) Notice: Subject to any disclaimer, the term of this patent is extended or adjusted under 35 U.S.C. 154(b) by 0 days.

(21) Appl. No.: 16/154,635

(22) Filed: Oct. 8, 2018

(65) Prior Publication Data

US 2020/0109552 A1 Apr. 9, 2020

(51) Int. Cl.
*E04B 1/32* (2006.01)

(52) U.S. Cl.
CPC ..... *E04B 1/32* (2013.01); *E04B 2001/3217* (2013.01); *E04B 2001/3241* (2013.01); *E04B 2001/3252* (2013.01)

(58) Field of Classification Search
CPC ..... E04B 1/32; E04B 2001/3217; E04B 2001/3252; E04B 2001/3241; E04B 1/3205; E04B 2001/3583; E04C 3/38; E04C 3/42

(Continued)

(56) References Cited

U.S. PATENT DOCUMENTS 321,939 A * 7/1885 Bates ..... E04D 3/365 52/534
506,732 A * 10/1893 Scheidler ..... E04B 1/26 52/92.1

(Continued)

FOREIGN PATENT DOCUMENTS

EP 2103750 A1 * 9/2009 ..... E04B 1/3211
ER 14144 A1 * 1/1980
JP 05248026 A * 9/1993

OTHER PUBLICATIONS

Jack M. Tucker, 3 photographs of an experimental non-fortified (not as if monolithic) radial arch structure limited posting between Dec. 26, 2016 and Jan. 17, 2017, posted at facebook.com, [online], [site visited Aug. 23, 2018], 4 pages, available from Internet, <URL: https://www.facebook.com/profile.php?id=100014587124343>.

*Primary Examiner* — Ryan D Kwiecinski
*Assistant Examiner* — Matthew J Gitlin
(74) *Attorney, Agent, or Firm* — Howard Russell

(57) ABSTRACT

Arch structure defining equidistant points along a radial curve and comprising uniformly-sized, standard stock, elongated rectangular cross-section stringer members, uniformly-sized, standard stock, elongated rectangular cross-section arch members each having a midpoint and first and second angled ends of equal but opposing to one another angular magnitude, each arch member adapted to converge crossways on and completely abut a side surface of two non-adjacently positioned stringer members, each of the arch members further being adapted for undergirding a stringer member located between two non-adjacently positioned stringer members at the mid-point of the arch member, each arch member adapted for being oriented in scissor-like crossing relationship to another arch member, a plurality of fasteners, and where needed at least one tensioning member preferably attached between end stringer members, or alternatively between foundation members, the tensioning members and fasteners making the arch structure fortified to be as if monolithic.

12 Claims, 18 Drawing Sheets

(58) Field of Classification Search
USPC ... 52/86, 369, 641, 642, 643, 644, 667, 668, 52/223.9, 291, 639; 14/3, 24, 25; 135/4 R
See application file for complete search history.

(56) References Cited

U.S. PATENT DOCUMENTS 844,212 A * 2/1907 Thaden ..... E04B 1/10 52/92.3
2,187,009 A * 1/1940 Beattie ..... E04C 3/42 52/642
2,350,904 A * 6/1944 King ..... E04B 1/3445 52/264
2,874,812 A * 2/1959 Clevett, Jr. ..... E04C 3/005 182/163
3,091,002 A * 5/1963 Nicholson ..... E04B 1/3441 52/641
3,897,622 A * 8/1975 Utahara ..... A01G 9/1407 29/452
3,968,808 A * 7/1976 Zeigler ..... E04B 1/19 135/145
3,985,459 A * 10/1976 Gilb ..... E04B 1/49 403/217
3,999,338 A * 12/1976 Behan, Jr. ..... E04B 7/02 52/90.1
4,156,433 A * 5/1979 Beaulieu ..... E04B 1/3441 135/145
4,284,094 A * 8/1981 Behrend ..... E04H 15/48 135/123
4,373,305 A * 2/1983 Russell ..... E04B 1/32 52/64
4,412,405 A * 11/1983 Tucker ..... E04B 1/3205 446/106
4,689,932 A * 9/1987 Zeigler ..... E04B 1/3211 52/653.1
4,841,688 A * 6/1989 Rinaldi ..... E04H 15/322 52/63
4,894,964 A * 1/1990 Thrift ..... E04B 1/26 52/199
5,218,801 A * 6/1993 Hereford ..... E04B 7/022 52/223.9
5,323,573 A * 6/1994 Bakewell, III ..... E04B 1/3205 52/223.7
5,333,421 A * 8/1994 McKenna ..... E04B 1/3205 52/63
5,363,627 A * 11/1994 Wilson ..... A01G 9/16 52/641
5,417,027 A * 5/1995 Wagenet ..... A63B 9/00 446/125
5,655,347 A * 8/1997 Mahieu ..... E04C 3/38 14/12
6,170,209 B1 1/2001 Dagher et al.
6,360,509 B1 * 3/2002 Sluiter ..... E04C 3/07 52/634
6,679,009 B2 * 1/2004 Hotes ..... E04H 15/36 135/117
7,533,498 B2 * 5/2009 Zeigler ..... E04B 1/3205 135/128
7,712,261 B2 * 5/2010 Zeigler ..... E04H 15/50 135/128
8,910,428 B2 * 12/2014 Rule ..... E04B 7/20 52/272

* cited by examiner

FORTIFIED RADIAL ARCH STRUCTURE

BACKGROUND OF INVENTION

The present invention relates to a radial arch building structure, and more particularly to a fortified to be as if monolithic radial arch structure that may be constructed of generally-available, relatively inexpensive, preferably wooden, and substantially uniform, components, capable of being mass-produced remotely from a use site, and to torn a larger, weight-bearing-capable, generally-tubular structure viewed as having a complete circle viewed in cross section, or a generally-curved such structure comprising anything less than a complete circle viewed in cross section.

The term monolithic is defined in the dictionary as, formed of a single large stone, and as applied to a building, being very large and characterless, and in particular, faceless (in the sense of being uniform). Therefore, the term "as if monolithic" is used herein to describe a structure with separate parts but which are combined and fastened together so as to be capable of functioning as an integral and larger whole structure, and to be capable, for example, of being moved as a whole (as a unitary piece of stone), as for example would be the case being lifted with a cable dangling from a crane or a helicopter and attached at a single point, or multiple points, near the top of the monolithic radial arch structure, and also so that the monolithic radial arch structure can stand on its own, support weight on top of it, and successfully resist substantial shifting forces, lateral forces, and shear forces, all without damage to, destruction of, or disassembly of, the structure.

Such as if monolithic structures may be advantageous, since they may be, for example, capable of construction of many varying sizes in a covered, air-conditioned, weather and climate-controlled, fabrication facility with necessary tools and components readily available, and then, though preferably made of wood, they may be easily lifted from an upper securetnent point, or points, and transported to the field where the structures may be successfully used.

There continue to be needed, and there will continue to be needed in the future, arch structures capable of use for the construction of subway tunnels, for hypertubes for above-ground transport, for inhabitable building structures, for greenhouse structures, arched trellis structures, shade and weather shelters, flotation structures, and for other useful objects and systems. In such applications, having an as if monolithic structure comprised of a plurality of fortified uniform parts would be advantageous, since the structure could be mass-produced in a remote warehouse, out of the elements, and easily transported to the use site.

Subway tunnels have been formed by a process wherein a tunnel is dug in the side of a hill, the tunnel being just large enough to accommodate building an arched structure within the tunnel to create a form for receiving reinforced concrete to be poured or pumped in the space between the tunnel walls and the form. Then, preferably once the poured concrete has hardened, the form would be removed and re-built, or otherwise used, in another section of the tunnel. For such operations, it may be advantageous to use a fortified to be as if monolithic semi-circular (in cross-section) wooden, steel, or aluminum, arch structure.

Regarding an above-ground hypertube, an acceptable method of constructing an above-ground hypertube would be to create a fully circular cross-section tube capable of being covered, such as sheeted, and for the creation of a vacuum environment within the hypertube capable of sustaining transport of a vehicle or person through the tube, either on rails, electromagnetic or otherwise, and while withstanding the vacuum forces tending to implode such a structure. For such operations, it would be advantageous to use a fortified to be as if monolithic fully-circular (in cross-section) arch-structure tubes.

Of course, arched structures are known generally, whether they have been created from stone, timber, steel, reinforced concrete, aluminum, or other building materials, and such have proven useful for creating tunnels, buildings, barracks, warehouses, shelters, arched-trellises, and other structures. But to date there has been lacking a monolithic-type such arch structure, preferably made of wood and capable of constructed remotely from generally uniformly-sized, and relatively-smaller, materials, likewise capable of being moved as a completed structure from the fabrication location to a field use location.

In U.S. Pat. No. 4,412,405 to Tucker, there is provided a radial arch structure constructed from relatively short and straight members or beams angularly related and forming chords of a generally curved, or circular, arc, which structure may have been erected by a minimum number of persons. While such may have been employed in the form of a roof, or roof supporting, structure mounted between a pair of walls to keep the arch structure from collapsing, such structures as disclosed in the '405 patent are not as if monolithic.

This is largely because the '405 patent radial arch structure has required intermediate midway-positioned notches in longitudinally-extending (stringer) members, as well as intermediate midway-positioned notches and end notches in transverse (arch) members, to help hold the arch structure of the '405 patent together against an anchoring point relative to a wall or foundation. Such application of notches and such need for anchoring have made the '405 patent not readily mobile and non-as-if-monolithic. Further, this need for notches has taught away from the use of fasteners and has weakened the members of the '405 patent structure, thus having weakened the resulting structure and having made it unsuitable for larger, heavier, and load bearing structures. This, in turn, has substantially limited the size and types of structures feasibly capable of being constructed in accordance with the '405 patent. Further, the notching and need for anchoring for such structures made according to the '405 patent have been complicated in the process of their construction, such that such structures have not been commercially or structurally feasible from an engineering standpoint.

Structures according to the '405 patent's teachings have therefore been limited in size so that they could not, for example, readily carry the load of a larger structure such as that required for building a subway tube, sections of a hypertube, flotation devices for floating housing, or a relocatable structure such as military barracks in the field. This has been because as larger materials have been sought for withstanding larger loads associated with these types of applications, the '405 patent structure has, per its terms, required increasingly large intermediate and end notches which have unduly weakened the structural integrity of the members. As such, engineering and permitting entities generally have not been readily willing to approve such structures for larger load bearing buildings and structures.

Further, the radial arch structure of the '405 patent has not employed intermediate fasteners between each of the members of the structure, and nor has it employed a post-tensioning type cable for holding the structure together. Thus, the arch structure of the '405 patent has required mounting or otherwise securing to fixed anchors on both sides of the arch (in the case of a barracks type building with sidewalls and a semi-circular cross-section root) to create sufficient integrity so that the arch would not have collapsed, so long as it has remained anchored. With such a structure, earthquake proofing has required the use of Simpson® brand ties comprising sometimes angled brackets fastened at component interfaces as known in the art. And, thus again, such an arch has been non-as-if-monolithic and not practical as a removable structure, especially without such ties, since it could not have survived easy-access uplift (as with a hook from a crane or helicopter attached at an upper portion of the structure) or other removal and relocation, without likely falling apart or otherwise collapsing. And thus, it would also be advantageous to have such an as if monolithic structure without the need for such ties.

Thus, there exists a need for simply-erected radial arch structures, preferably comprised of wood, but also able to be constructed of aluminum, steel, or other suitable material, that may span up to a generally complete cross-section circle, or generally having some degree less of an arched cross-section. Such radial arch structures may be temporary or permanent, and they would be preferably monolithic and capable of carrying, or withstanding, heavier loads and capable of spanning a required reasonable distance or space. Preferably, such structures would be capable of being constructed by a minimum number of persons without advanced knowledge of construction techniques or tools. Thus, for example, it would be advantageous for relatively unskilled individuals to be able to assemble temporary semi-circular cross-section radial arch buildings, made of wood, to shelter large numbers of persons or things, all from a plurality of largely uniform parts, and with the resulting structure being capable of being moved as if a monolithic structure by lifting as with a hook, or hooks, adjacent an upper portion of the structure. Further, there exists a need for such radial arch structures that are capable of being formed, preferably of wood, in a dome-shaped, or alternatively spherical-shaped, as if monolithic structure.

Regarding higher, or very high, load-bearing structures, there have been provided means of fortifying such, and there has been some reluctance to use wood, including pre-stressed wood components for such, because such components may be seen as more likely to break down over time, and thus have required updating of pre-stressing of such. See, e.g., U.S. Pat. No. 6,170,209 to Dagher et al., for Prestressing System For Wood Structures and Elements. Though the Dagher system is considered unlike that of the present disclosure in many respects, it may be considered instructive regarding building of more sturdy wooden structures in general.

SUMMARY OF THE INVENTION

In accordance with an aspect of the invention, there is provided a radial arch structure, part of the points along a cross-section outline of which defines equidistant points along a radial curve. The radial arch structure in accordance with this aspect of the invention comprises: a plurality of elongated rectangular cross-section stringer members, each stringer member of the plurality of stringer members comprising opposing first and second side surfaces lying in substantially parallel planes, and a plurality of elongated rectangular cross-section arch members, each of the plurality of arch members having a midpoint and first and second opposing angled ends of equal but opposing to one another angular magnitude, the ends of each of the plurality of arch members being shaped to be adapted to converge crossways on and completely abut as a flat surface, so abutting without any step or notch in the arch member or the stringer member, a side surface of two non-adjacently positioned of the plurality of stringer members, each of the plurality of arch members further being adapted for surface-to-surface, preferably being spinning-attachment-construction-enabled with double-threaded lag bolts, undergirding a one of the plurality of stringer members located between two non-adjacently positioned stringer members at the mid-point of each of the plurality of arch members.

The radial arch structure in accordance with this aspect of the invention further comprises a plurality of fasteners interconnecting at least one end of each arch member to a stringer member, but preferably each end of each arch member to a stringer member, each fastener being fastened to make the arch structure fortified to be as if monolithic and capable of withstanding, without damage to the structure, sufficient gravitational weight and load-type forces, sufficient side-to-side shifting type forces, and sufficient uplift-type threes, as for example resulting from lifting the structure by a hook adjacent an upper portion of the structure.

Such a radial arch structure in accordance with this aspect of the invention may, in an embodiment, comprise a portion of the structure defining a radial curve defining the points of an incomplete circle, or in other words arcs of a circle, further comprising a plurality of end stringer members, and wherein each of the plurality of stringer members other than the plurality of end stringer members is an intermediate stringer member, each end stringer member positioned crossways of the arch members at outermost extents at the beginning and end of each thus created arc of the circle, further comprising a plurality of end arch members, and wherein each of the plurality of arch members other than the plurality of end arch members is an intermediate arch member, each of the plurality of end arch members having a first end and a second end, the first end of each of the plurality of end arch members having an angle adapted for fully abutting to the maximum degree possible given chosen material sizes, surface-to-surface without any steps or notches, with a one of the plurality of intermediate stringer members, the second end of each of the plurality of end arch members comprising one of an opposing angle of equal angular magnitude to the first end of the end arch member and adapted for fully abutting flat surface to flat surface, and to the degree possible, without any steps or notches, an opposing side surface of one of the plurality of end stringer members and bypassing one of the plurality of end stringer members, each of the end arch members and the intermediate arch members further being oriented in scissor-like crossing relationship to another of the plurality of end arch members and intermediate arch members. Preferably, in accordance with an aspect of the invention, each of the end arch members and intermediate arch members are further interconnected with fasteners at their scissor-like crossing junctions or locations.

The arch structure of this embodiment of this aspect of the invention may be such that the cross-section of parts of the structure defining a radial curve define the points of an 180-degree semi-circle, and wherein the plurality of end stringer members comprises two end stringer members of wider width for capping the arch structure, each end stringer member being positioned at diametrically opposed locations on the defined semi-circle, and further comprising a plurality of special arch members, each special arch member having a longitudinal axis, a first end and a second end, wherein each of the second ends of each end arch member comprises an opposing angle of equal angular magnitude to the first end of the end arch member and adapted for fully abutting flat surface to flat surface, to the degree possible without any steps or notches, an opposing side surface of one of the plurality of end stringer members, and wherein the first end of each special arch member has an angle adapted for fully abutting flat surface to flat surface to the degree possible with one of the plurality of intermediate stringer members, the second end of each special arch member having an angled surface adapted for fully abutting to the degree possible (for that angle cut) a side surface of one of the plurality of end stringer members, each of the plurality of end arch members and the plurality of special arch members further being oriented in scissor-like crossing relationship to another of the plurality of end arch members and the plurality of special arch members. In accordance with an aspect of the invention, the end arch members and the special arch members may also be interconnected with fasteners at those locations at which they cross in scissor-like fashion to further solidify the integrated structure and make it more fortified to be as if monolithic (in the integral, solid large entity, sense of the word).

In accordance with this aspect and an embodiment of the invention, the parts of the arch structure defining a radial curve may define the points of a full circle, wherein each of the plurality of stringer members is an intermediate stringer member, and wherein each of the plurality of arch members is an intermediate arch member, each of the plurality of intermediate arch members further being oriented in scissor-like crossing relationship to another of the plurality of intermediate arch members. In accordance with an aspect and embodiment of the invention, the intermediate arch members may be fastened with fasteners to their respective scissor-crossing intermediate arch members to further solidify the integral arch structure.

In accordance with another aspect and embodiment of the invention, there is provided an arch structure like that described above regarding a part, or arc, of a circular arch portion, wherein each of a plurality of the plurality of end arch members bypassing one of the plurality of end stringer members further comprises an integral elongated wall stud member, the arch structure further comprising at least one foundation member, the first end of each wall stud member abutting the next adjacent intermediate stringer member to the end stringer member, and the second end of each at least one wall stud member being connected to the at least one foundation member.

In accordance with another aspect of the invention, the various arch structures of the invention may be suitably and even advantageously used for various different types of structures or applications. Thus, in accordance with this aspect of the invention, either of the arch structures claimed, whether one defining a part of a circular in cross section (e.g., one that is 180-degrees or greater number of degrees but less than 360 degrees), or another one defining a complete circle (i.e., 360-degrees cross section, wherein the arch structure forms a frame structure for an elongated hull of a flotation device. Such device may further preferably comprise a plurality of fasteners to further interconnect scissor-crossing arch members, and may also further preferably comprise at least one, and preferably a plurality, of tensioning members.

Further, in accordance with this aspect of the invention, there is provided an arch structure of an embodiment defining a complete circle in cross section, wherein the arch structure forms a frame structure for an elongated above-ground tube, as may be supported to form the structure for a hypertube transport structure employing vacuum or other high-speed transport technology. Such device may further preferably comprise a plurality of fasteners to further interconnect scissor-crossing arch members, and may also further preferably comprise at least one, and preferably a plurality, of tensioning members.

Still further, in accordance with this aspect of the invention, there is provided an arch structure wherein the cross section of parts of the structure defining a radial curve define the points of less than a complete circle, and wherein the arch structure forms a frame structure for one of a sun shade structure, a barracks structure, and an arched trellis arbor structure. In the case of a sun shade structure, the arch structure frame structure preferably defines at least a quarter-circle, with the quarter-circle arch structure being integrated into a plurality of wall stud frame members extending past an end stringer member and connected at each second end of each wall stud frame member to a foundation member. In the case of a barracks structure, the arch structure frame structure preferably defines at least a half-circle, with the end stringer members preferably being bypassed by a plurality of end arch member wall stud members extending past each end stringer member and connected at each second end thereof to one of at least two foundation members. In the case of an arched trellis arbor structure, the arch frame structure likewise preferably defines at least a half-circle, with the end stringer members preferably being bypassed by a plurality of end arch member wall stud members extending past each end stringer member and connected at each second end thereof to a foundation member comprising one of a plurality of foundation members.

Yet further, in accordance with this aspect of the invention, there is provided an arch structure wherein the cross section of parts of the structure defining a radial curve define the points of less than a complete circle, preferably defining a 180-degree semi-circle, and wherein the arch structure forms a frame structure for a subway slip form. The structure in accordance with this aspect and embodiment of the invention preferably is provided wherein the plurality of end stringer members comprise two end stringer members of wider width for capping the arch structure, each end stringer member being positioned at ultimate extent locations on the defined radial curve. This embodiment also further comprises a plurality of special arch members, each of the plurality of special arch members having a first end and a second end, wherein the first end of each of the plurality of special arch members comprises an angle adapted for fully abutting to the degree possible flat surface to flat surface with one of the plurality of intermediate stringer members, and the second end of each of the plurality of special arch members has an angled surface adapted for fully abutting to the degree possible flat surface to flat surface a side surface of one of the plurality of end stringer members. Further, in accordance with this embodiment, each of the second ends of each of the plurality of end arch members comprises an opposing angle of equal angular magnitude to the first end of each of the plurality of end arch members and adapted for fully abutting to the degree possible flat surface to flat surface a side surface of one of the plurality of end stringer members, and each of the plurality of end arch members and the plurality of special arch members are further oriented in scissor-like crossing relationship to another of the plurality of end arch members and the plurality of special arch members. In accordance with an aspect of the invention, the end arch members and special arch members of this aspect and embodiment of the invention may be fastened together at their scissor-like intersections, or junctions, to further solidify the overall structure and help render it fortified to be as if monolithic.

In accordance with another aspect of the invention, there is provided an arch structure further comprising at least one tensioning member, and preferably a plurality of tensioning members, one tensioning member for each course of a plurality of arch members, that is for each plurality of arch members linearly oriented along a given longitudinal circumferential line of a structure, there preferably being at least one tensioning member for each such longitudinally-oriented plurality of arch members. Such tensioning member, or preferably plurality of tensioning members, are each of the post-tensioning type, meaning that the tensioning member is applied to the structure after the structure is fastened together with fasteners. In this way, the tensioning member is tightened and placed in tension, which in turn puts at least a part of the arch members of the structure in compression, thus compressing each arch member so that it presses onto the stringer member to which it is attached. Such post-tensioning further strengthens the integrity of the structure and thereby makes the structure more fortified to be as if monolithic and thus capable of withstanding, without damage to the structure, sufficient gravitational weight and load-type forces, sufficient side-to-side shifting type forces, and sufficient uplift-type forces, as for example resulting from lifting the structure by a hook adjacent an upper portion of the structure.

Each at least one tensioning member has first and second ends, and each end of each at least one tensioning member is fastened to one of the stringer members, such as an end stringer member in the case of a partial circle cross-section type arch structure, and one of the arch members. Each at least one tensioning member extends along each of the defined points of the radial curve defined by the arch members of the arch structure, each at least one tensioning member being capable of being tightened such that, together with the fasteners, the arch structure is made fortified to be as if monolithic.

The at least one tensioning member of this aspect of the invention may be applied to the arch structure whether it is a part-of-a-circle-type of arch structure, or whether it is a complete-circle-type of arch structure. However, it will be appreciated that technically there is no beginning, or end, stringer members with a complete-circle-type of arch structure, therefore, it will be appreciated that the ends of each at least one tensioning member will be attached to one, or more, intermediate stringer members in that case. Still further, each at least one tensioning member may extend past an end stringer member and further interconnect the arch structure with the at least one foundation member of an arch structure shade structure, a barracks structure, and/or an arched trellis arbor structure. Yet further, it will be appreciated that the at least one tensioning member may be applied to a complete circular cross section arch structure framework, in the case of an elongated tubular, or partially tubular, flotation device frame work, or an elongated tubular hypertube structure framework. In the case of a part circular cross-section structure, the at least one tensioning member may be applied with each end of the tensioning member attached to an end stringer member, the tensioning member thus, upon tightening, rendering it fortified to be as if monolithic the part circular cross-section structure.

Each of the various types of arch structures set forth and claimed herein, whether partial-circle-type, complete-circle-type, 180-degree-semi-circle-type, or combined-wall-stud-and-partial-circle-type, may be strengthened in its structural integrity and monolithicness with at least one, and preferably a plurality, of tensioning members. Such tensioning members preferably comprise, for example, a twisted wire cable having a common spinning turnbuckle-type, threaded eyeloop-type, ratchet-type, or other common tensioning hardware thereon for tightening and thus applying tensioning to the tensioning wire cable. And of course, it will be appreciated by those skilled in the art that, as tension is applied to each tensioning member, this in turn creates compressive forces within individual arch members, and to a lesser degree stringer members, thus tending to solidify the overall structure into a more integral structure.

Thus, where higher-stress, higher load-bearing, and typically heavier such structures are desired, post-tensioning members may be employed to fortify the structure to render it as if monolithic. And where such structures may be inaccessible, or to some degree inaccessible, thought is to be given to the degree to which such structures should be comprised of wood, or pressure treated lumber, versus aluminum, steel, or other suitable material, which may be coated, treated, padded or guided with tracks or implements to prevent the breakdown of whatever material is chosen suitable for a given application. Regardless of the materials chosen, however, it will be appreciated that the structure may be possibly further fortified to be made more as if monolithic with post-tensioning, and in accordance with an aspect of the invention, the post-tensioning herein serves to lend integrity to the structure in a way that compresses arch members and/or stringer members, with multi-directional static forces aligned along such non-unidirectionally-oriented members (i.e., along arch members or stringer members oriented to approximate a radial arch curved surface) and partially terminating and opposed at fully abutting angled ends thereof on side surfaces of stringer members and side surfaces of arch members, to distribute such forces throughout the structure and thereby render the arch member fortified to be as if monolithic.

Thus, the foregoing aspects of the invention make clear that the present invention may be suitably used to create a diversity of radial arch structures, whether of partial circular cross-section, or of full circular cross-section, and such radial arch structures are not limited in size or strength by notches that otherwise limit prior structures. Thus, such structures may be made with larger-gage materials and therefore be made to support greater loads, whereas these structures are also rendered fortified to be as if monolithic with fasteners, and preferably post-tensioning members, especially in the case of wood or fastened aluminum structures where stronger welding bonds are not possible. Thus, even large structures may be picked up with hooks applied dangling from a crane, or other cable-type apparatus, connected to the structure at an upper lifting point, or lifting points, in order to easily move the structure from place to place as may be needed for certain given applications.

In accordance with another aspect and embodiment of the invention, there is provided an at least partially-domed arch structure, part of the points along a cross-section outline of which defines equidistant points along a plurality of intersecting normal longitudinal and latitudinal radially-arched curves. This at least partially-domed arch structure comprises: a plurality of elongated rectangular cross-section arch members, each of the plurality of arch members having a midpoint, first and second side surfaces lying in substantially parallel planes, and first and second angled ends of equal but opposing angular magnitude, the ends of each of the plurality of arch members being shaped to be adapted to completely abut an end of another of the plurality of arch members, each of the plurality of arch members having a longest length parallel to a longitudinal length of each arch member and a shortest length parallel to the longitudinal length of each arch member, each end at each longest length of each of the plurality of arch members being abutted and oriented to define equidistant points along the longitudinal radial curves defined along the cross-section outline of the partially-domed structure.

The at least partially-domed arch structure of this aspect and embodiment of the invention further comprises: a plurality of levels of courses of a plurality of elongated rectangular cross-section stringer members, each stringer member of each course of the plurality of courses of stringer members being of equal length, each course of stringer members being positioned an increasingly large distance from a central point of the partially-domed arch structure, up to an equatorial inflexion point (if a more spherical type structure is employed), such that increasingly longer stringer members are required to span the entire latitudinal curvature of the arch at each given course level of increasingly larger distance from the central point of the partially-domed arch structure up to the equatorial inflexion point (at which point each given course level of stringer members begins to be comprised of increasingly smaller stringer members), and such that each increasingly larger course of stringer members requires increasingly longer stringer members to span the increasingly longer longitudinal arc at each increasingly distant course level from the central point. Each such stringer member comprises first and second opposing angled ends of equal but opposing angular magnitude, each end of each of the plurality of stringer members being shaped to be adapted to converge crossways on and completely abut a side surface of one of the arch members. Further, each such stringer member has a longest length, and a shortest length, each length being parallel to the longitudinal length of each stringer member, each end of each longest length of each of the plurality of stringer members being abutted and oriented to define equidistant points along the latitudinal radial curves defined along the cross-section outline of the partially-domed arch structure.

Still further in accordance with this aspect and embodiment of the invention, there are provided a plurality of fasteners interconnecting at least one end of each stringer member to an arch member, but preferably each end of each stringer member to an arch member, to make the arch structure fortified to be as if monolithic. As with previous embodiments of the invention, the arch members may preferably be provided such that each arch member is adapted to span and interconnect every other, non-adjacent, stringer members, and further each arch member may likewise be adapted to undergird every other stringer member, except with this aspect and embodiment of the invention, the arch members undergird the stringer members at a location where two stringer members abut as fully as possible, flat surface to flat surface, opposing side surfaces of adjacent and end-to-end abutting arch members.

In accordance with an aspect and embodiment of the invention, the at least partially-domed arch structure of this foregoing aspect and embodiment of the invention further comprises a plurality of tensioning members, each tensioning member having first and second ends, each end of each tensioning member being fastened to one of an arch member and a stringer member, each tensioning member extending along a plurality of defined points along a radial curve defined by the at least partially-domed arch structure. Each such tensioning member is capable of being tightened, such that together with each fastener being fastened, the at least partially-domed arch structure is fortified to be made as if monolithic, and therefore capable of withstanding, without damage to the structure, sufficient gravitational weight and load-type forces, sufficient side-to-side shifting type forces, and sufficient uplift-type forces, as for example resulting from lifting the structure by a hook adjacent an upper portion of the structure.

In accordance with another aspect of the invention, arch structures and at least partially-domed structures may be combined. In such a case, there is provided an arch structure, wherein the arch structure defines first and second end openings, the arch structure further comprising an at least partially-domed arch structure defining an equally-sized and opening fastened adjacent at least one end opening of the arch structure. As with other at least partially-domed structures defined herein, the partially-domed structure of this aspect and embodiment of the invention comprises a plurality of elongated rectangular cross-section arch members, each of the plurality of arch members having a midpoint, first and second side surfaces lying in substantially parallel planes, and first and second angled ends of equal but opposing angular magnitude, the ends of each of the plurality of arch members being shaped to be adapted to completely abut an end of another of the plurality of arch members. Further, in accordance with this aspect and embodiment of the invention, each of the plurality of arch members has a longest length parallel to a longitudinal length of each arch member and a shortest length parallel to the longitudinal length of each arch member. Each end at each longest length of each of the plurality of arch members is abutted and oriented to define equidistant points along the longitudinal radial curves defined along the cross-section outline of the partially-domed structure.

Further, there are provided a plurality of levels of courses of a plurality of elongated rectangular cross-section stringer members, each stringer member of each course of the plurality of courses of stringer members being of equal length, each course of stringer members being positioned an increasingly large distance (up to an equatorial midpoint if a more spherical structure is employed) from a central point of the partially-domed arch structure such that increasingly longer stringer members are required to span the entire latitudinal curvature of the arch at each given course level of increasingly larger distance from the central point of the partially-domed arch structure, and such that each increasingly larger course of stringer members requires increasingly longer stringer members to span the increasingly longer longitudinal arc at each increasingly distant course level from the central point.

Further, in accordance with this aspect and embodiment of the invention, each stringer member comprises first and second opposing angled ends of equal but opposing angular magnitude, each end of each of the plurality of stringer members being shaped to be adapted to converge crossways on and completely abut a side surface of one of the arch members. Further, each stringer member has a longest length, and a shortest length, each parallel to the longitudinal length of each stringer member, each end of each longest length of each of the plurality of stringer members being abutted and oriented to define equidistant points along the latitudinal radial curves defined along the cross-section outline of the partially-domed structure.

Still further, in accordance with this aspect and embodiment of the invention, there are provided a plurality of fasteners interconnecting at least one end of each stringer member to an arch member, but preferably each end of each stringer member to an arch member, and another plurality of fasteners interconnecting each stringer member course of the partially-domed arch structure to a stringer member of the arch structure, to make the combined arch structure and at least partially-domed arch structure fortified to be as if monolithic.

In accordance with an aspect and embodiment of the invention, there is provided an at least partially-domed arch structure wherein a plurality of the arch members of the partially-domed arch structure further comprise a plurality of domed structure opening arch members, wherein a plurality of the arch members of the arch structure further comprise a plurality of arch structure opening arch members, and wherein the plurality of fastening means further comprises a plurality of fasteners interconnecting the plurality of domed structure opening arch members to the plurality of arch structure opening arch members, to make the combined arch structure and at least partially-domed arch structure fortified to be as if monolithic.

Still further, in accordance with another aspect and embodiment of the invention, the at least partially-domed structure of previously-described embodiments and aspects of the invention may preferably further comprise a plurality of tensioning members, each tensioning member of the plurality of tensioning members having first and second ends, each end of each tensioning member being fastened to one of an arch member and a stringer member. Further in accordance with this aspect of the invention, each tensioning member extends along a plurality of defined points along a radial curve defined by the at least partially-domed arch structure, each tensioning member being capable of being tightened such that, together with each fastener being fastened, renders the combined arch structure and at least partially-domed arch structure fortified to be as if monolithic.

Thus, where higher-stress, higher load-bearing, and typically heavier such structures are desired, post-tensioning members may be employed to fortify the structure to render it as if monolithic. And where such structures may be inaccessible, or to some degree inaccessible, thought is to be given to the degree to which such structures should be comprised of wood, or pressure treated lumber, versus aluminum, steel, or other suitable material, which may be coated, treated, padded or guided with tracks or implements to prevent the breakdown of whatever material is chosen suitable for a given application. Regardless of the materials chosen, however, it will be appreciated that the structure may be possibly further fortified to be made more as if monolithic with post-tensioning, and in accordance with an aspect of the invention, the post-tensioning herein serves to lend integrity to the structure in a way that compresses arch members and/or stringer members, with multi-directional static forces aligned along such non-unidirectionally-oriented members (i.e., along arch members or stringer members oriented to approximate a radial arch curved surface) and partially terminating and opposed at fully abutting angled ends thereof on side surfaces of stringer members and side surfaces of arch members, to distribute such forces throughout the structure and thereby render the arch member fortified to be as if monolithic.

Thus, in accordance with one or more of the foregoing aspects of the invention relating to an at least partially-dome shaped structure, there are provided a number of structures that are both appealing visually, are highly functional, and are capable of being constructed of readily-mass-produced, and commonly-available relatively inexpensive materials (such as standard wood stock or aluminum stock), all capable of being manufactured at a remote, covered, air-conditioned, location and transported, either in whole or in chunks or portions, to a final construction location in the field.

Further, with the foregoing aspects of the invention, there are provided a number of different alternatives for mixing and matching of structures, fasteners, and tensioning systems, all without departing from the true scope of the invention as claimed. Thus, it will be appreciated by those skilled in the art that there are various possible combinations of the above-described elements and sub-elements for various embodiments of the invention, whether such elements and sub-elements be combined in whole or in part, which may be employed without departing from the scope and spirit of the invention as claimed.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

DETAILED DESCRIPTION

Figure 1:
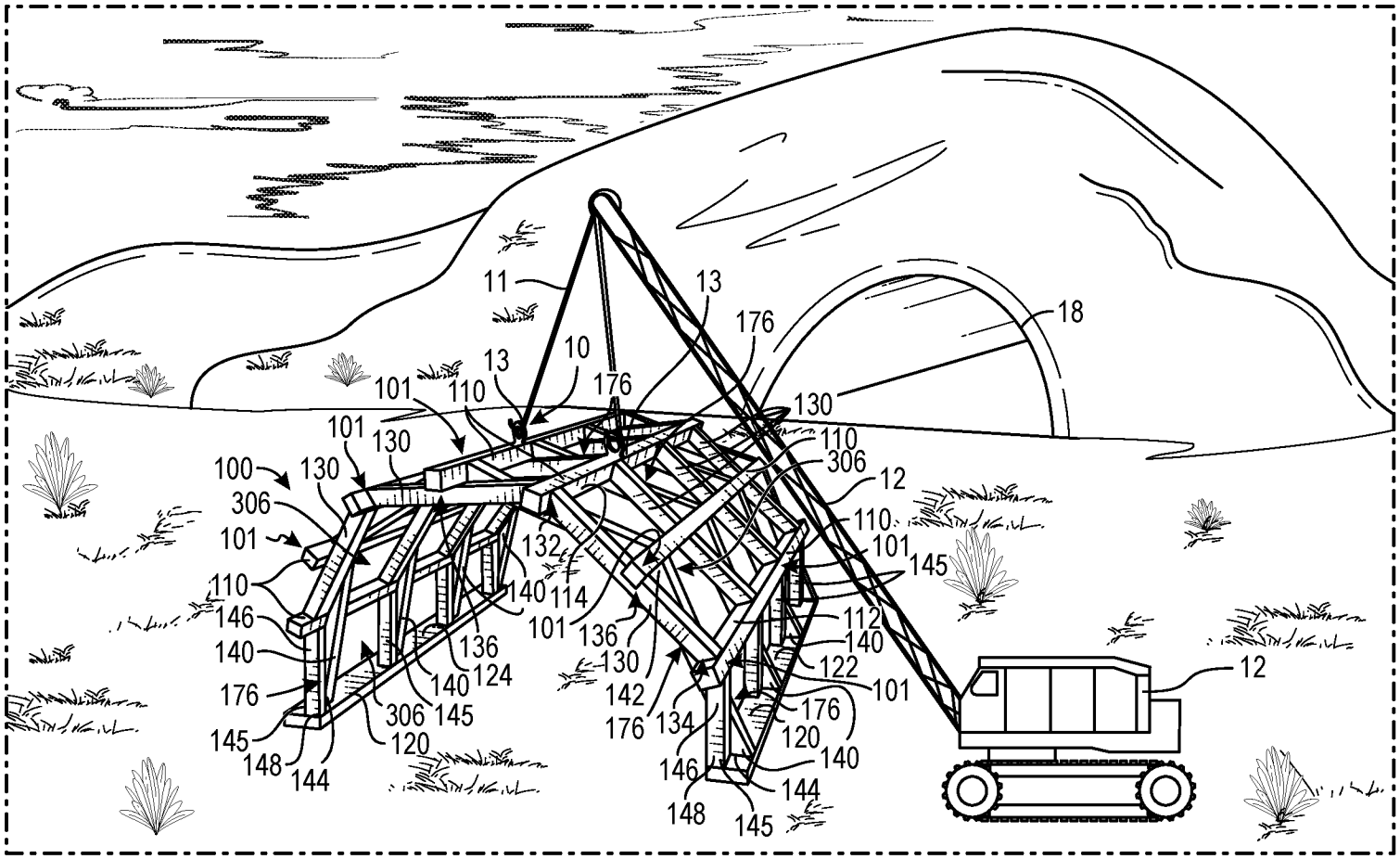
FIG. 1 is a perspective view illustration of an embodiment of the invention showing a half-tube radial arch structure in accordance with aspects of the invention.
Figure 7:
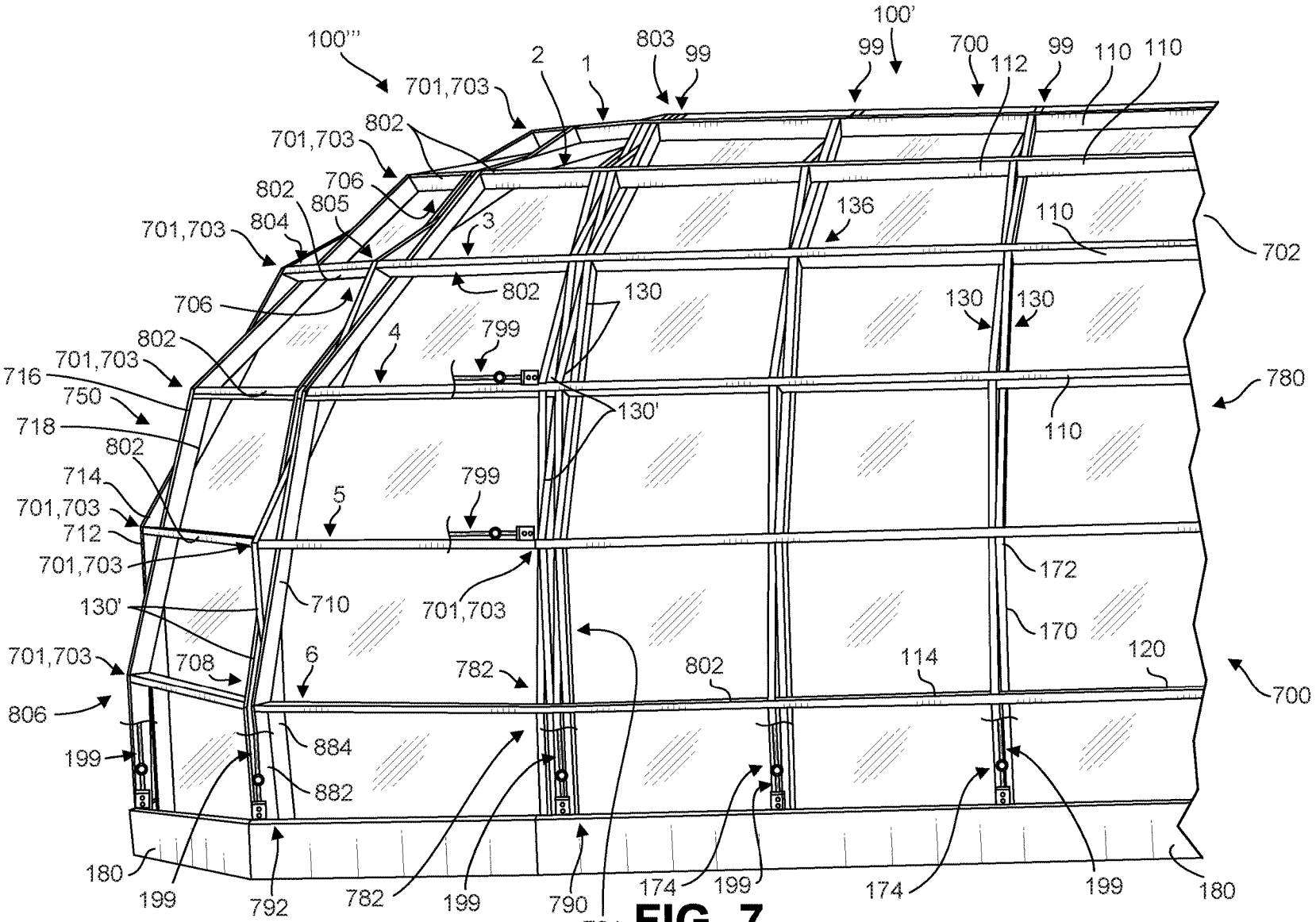
FIG. 7 is a side perspective view of a garden structure, or greenhouse, comprised of a half-tube radial arch structure and having a half-dome end.
Figure 8:
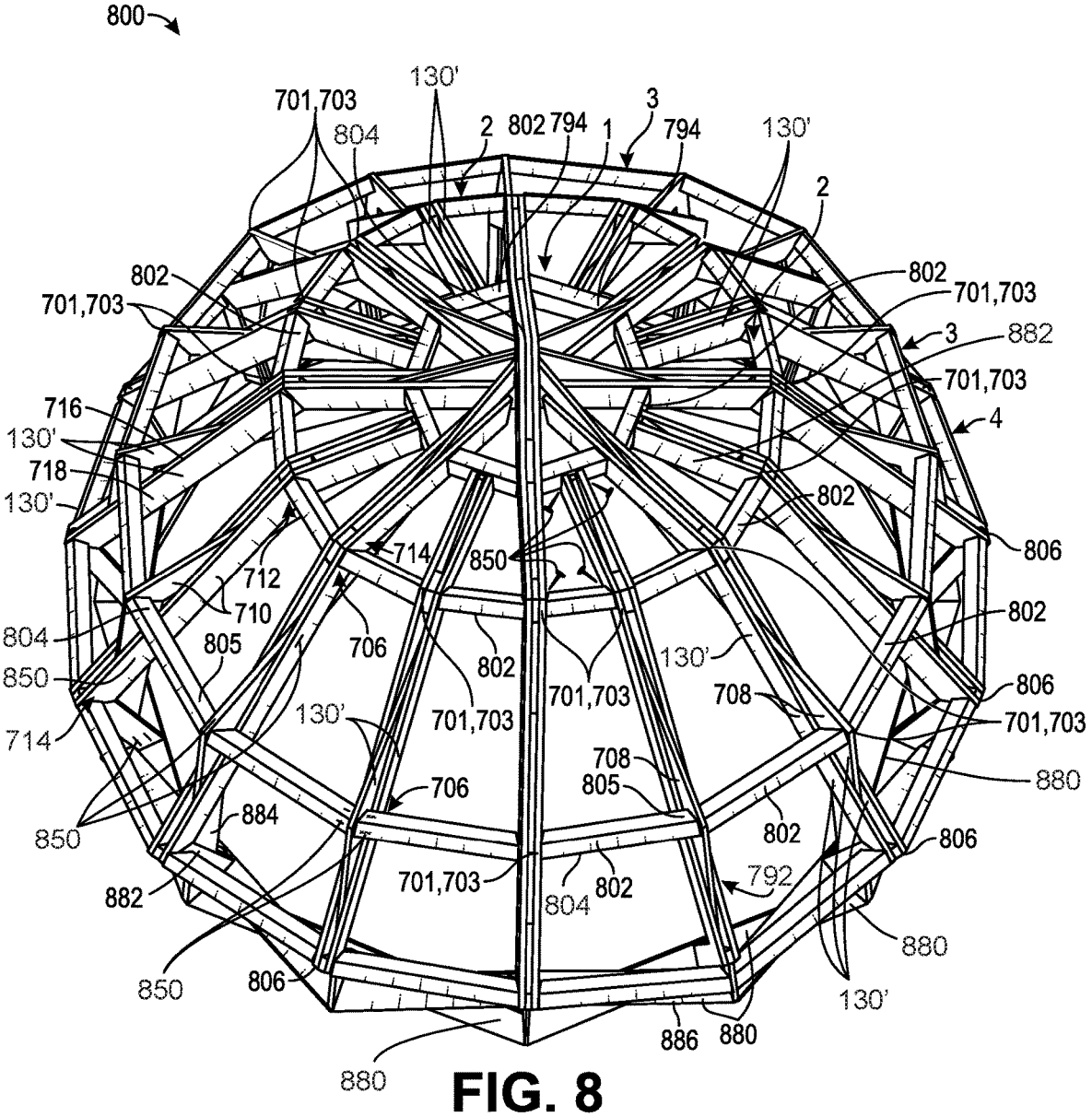
FIG. 8 is a top perspective view of a dome-shaped radial arch structure in accordance with one or more aspects of the invention.
Figure 11:
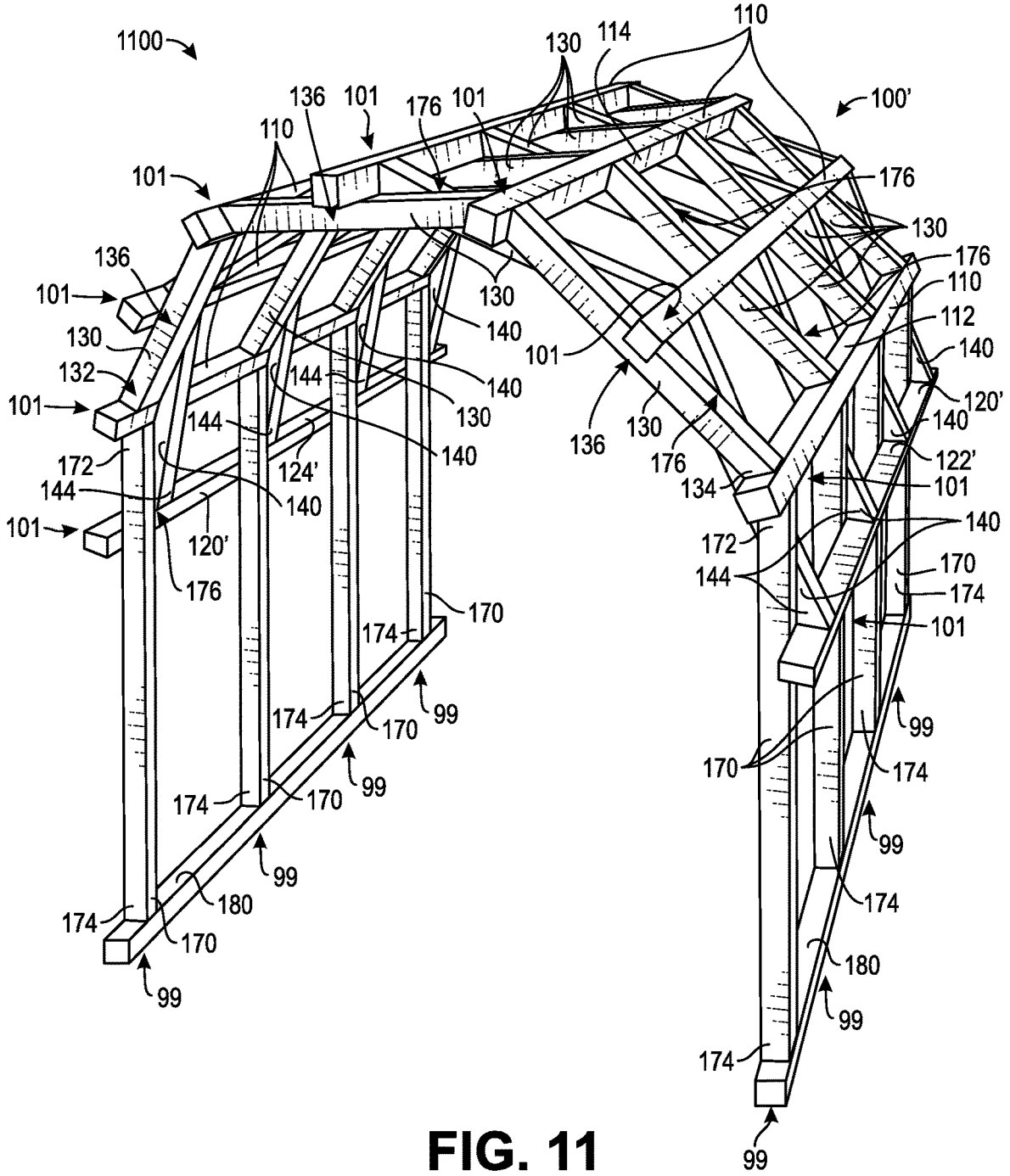
FIG. 11 is a front perspective view of an arbor having at least one foundation member, wall stud members, and a half-tube radial arch structure preferably interconnected in order to form an as if monolithic arbor trellis.
Figure 14:
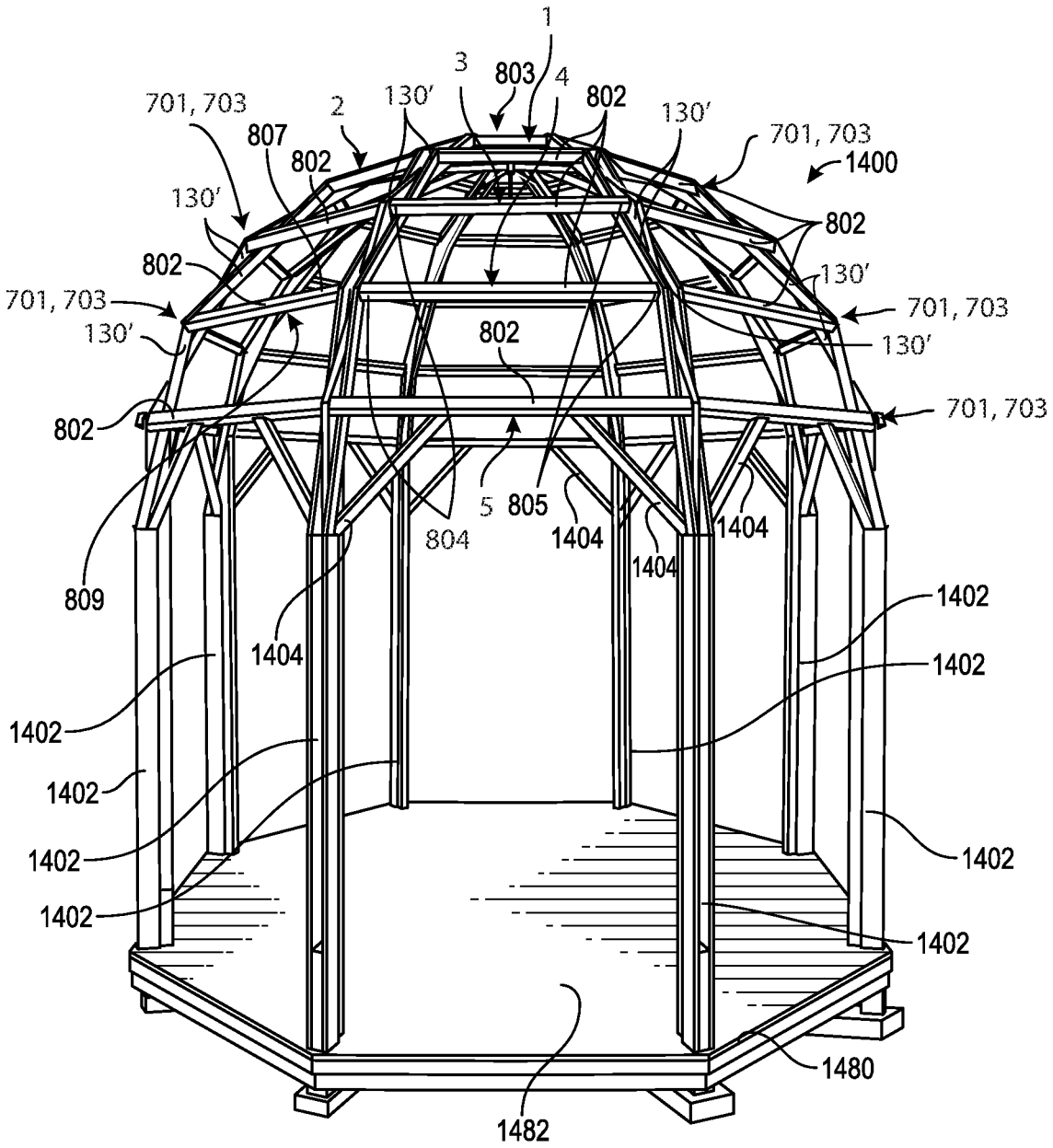
FIG. 14 is a gazebo-type structure made of a dome-shaped structure in accordance with an aspect of the invention, with the dome-shaped structure supported on and interconnected with pillar posts extending from a platform-type floor, and wherein post-tensioning, not shown, may optionally extend across a top of the structure from either the bottom of the pillar posts, a foundation member other than the floor (not shown), or the floor, so as to render the structure fortified to be as if monolithic.
Figure 15:
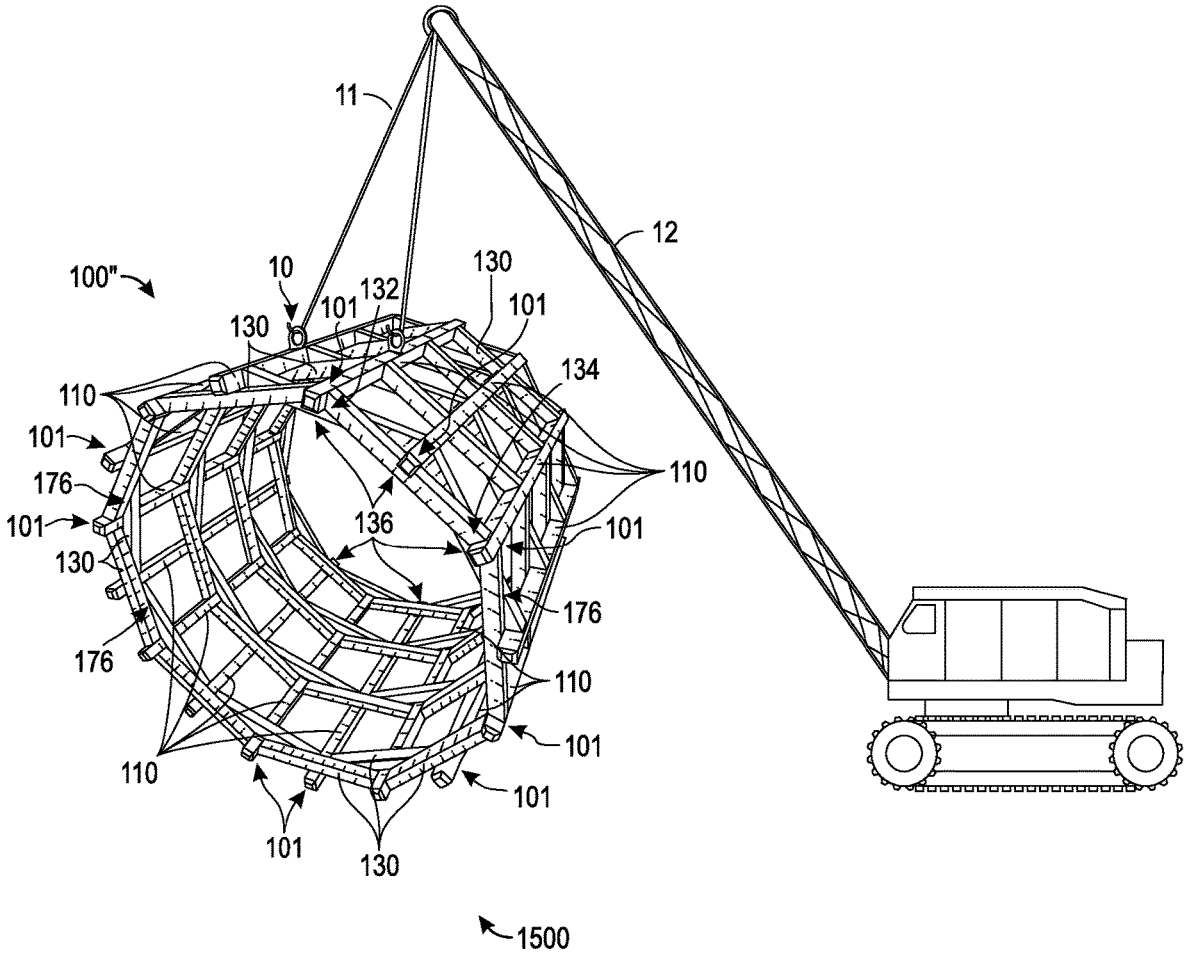
FIG. 15 is a tubular arch structure in accordance with one or more aspects of the invention and suitable for use, for example, as a welded-steel framework for an elongated tubular structure for a hypertube transport, or alternatively as a fastened wooden framework for a tunnel, structure preferably fortified with post-tensioning (not shown) to render the structure as if monolithic.

Referring to the FIGS., there are shown four basic types of radial arch structures 100 (semi-circular in cross-section with end plates as shown in FIG. 1), 100' (semi-circular in cross-section with wall stud-type special arch members as shown in FIG. 11), 100" (fully circular in cross-section as shown in FIG. 15), and 100'" (at least partially-domed as shown in FIGS. 7, 8, and 14). In those instances where descriptions below would be apparent to those skilled in the art to apply to any, or all, of the foregoing basic types of radial arch structures, whether 100, 100', 100", and/or 100'", such application is intended. Thus, for example, whereas descriptions below pertaining to definition of equidistant points 101 are made in connection with radial arch structure 100, these are also intended to the degree such would also clearly apply to radial arch structures 100',100", and 100'".

Figure 16:
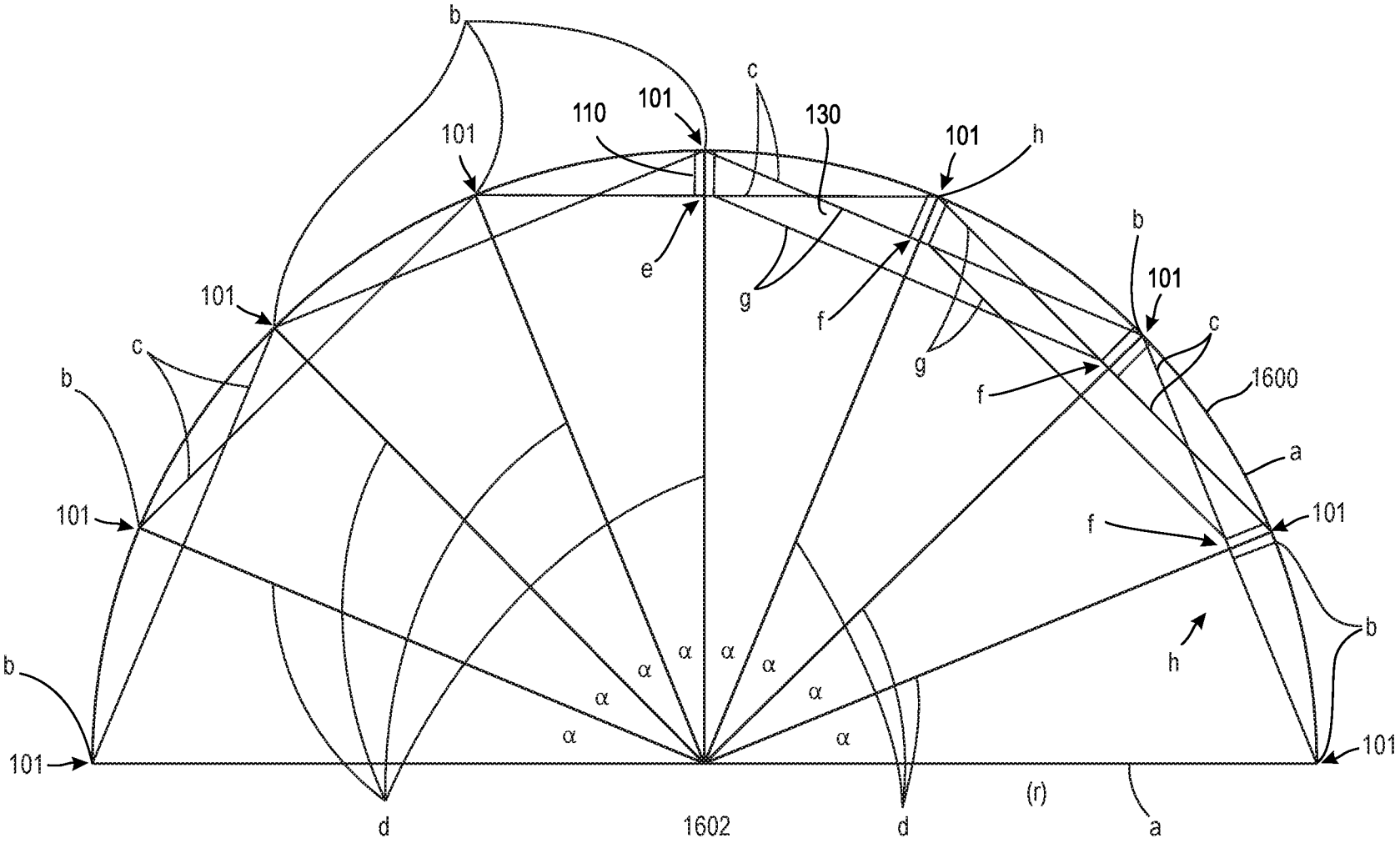
FIG. 16 is a diagram for assisting with explaining the method of laying out and designing an arch structure according to one or more aspects of the invention.

Referring additionally to FIG. 1, there is provided an arch structure 100, such as a radial arch structure, comprised of stringer members 110 and arch members 130 part of the points along a cross-section outline of which defines equidistant points, e.g., 101, along and defining a radial arc or curve 1600 (as shown in FIG. 16). As will be appreciated, points 101 are defined by each of a plurality of radial curves for each course of arch members 130 as further shown and described herein.

The radial arc 1600 is imaginary, except as drawn and planned on paper, or electronically, before a structure 100 is built, and there are nevertheless defining points 101 defined by equivalent points on each of repetitively-used and fungible components (such as arch members 130 and stringer members 110) of the arch structure 100 along such an arc. Such points 101 are therefore defined, such as at, among other locations, centrally-located imaginary intersecting points along projected outer surfaces of each stringer member 110 and projected outer surfaces of alternating abutting arch members 130 and undergirding arch members 130 (since the theoretical arc and points there-along must lie in a single plane), as shown.

Hence, part of the value of the invention is that the structures 100, 100', 100", 100'" are not only very visually-appealing structures, since they are designed with uniformly-divided arcs, but are also easy and inexpensive to build, since the materials used for their construction are preferably comprised of standardly-available-sized materials (e.g., 2×4, 4×4, 2×6, or 1×1, etc., primarily of wood, but also of aluminum, steel, or other suitable material if desired). Furthermore, the components of such arches are easy to mass produce and assemble in a weather and climate-controlled environment, wherein completed radial arch structures, or at least parts thereof, may be fastened together, and preferably tensioned, so as to be rendered fortified to be as if monolithic and therefore capable of relatively easy transport to a remote location.

Further, not only are the arches of the present invention all made of uniform size and shape components of minimal complexity from a manufacturing perspective, without any notches or steps in any one component, but such components are consistently oriented and repetitively combined at consistent radial intervals and corresponding repetitive angles, with the ends of the stringer members and arch members oriented along the circular and tubular orientation as further defined herein. Thus, it will be appreciated that the aforementioned defined equidistant points 101 at the ends of, and along, stringer members 110 and arch members 130 may be laid out, designed and planned, readily interconnecting them with a circular arc, as with a compass, as shown and further described below in connection with FIG. 16, to make an arch structure 100 which is both highly functional and strong, but also which is appealing to look at.

Figure 4:
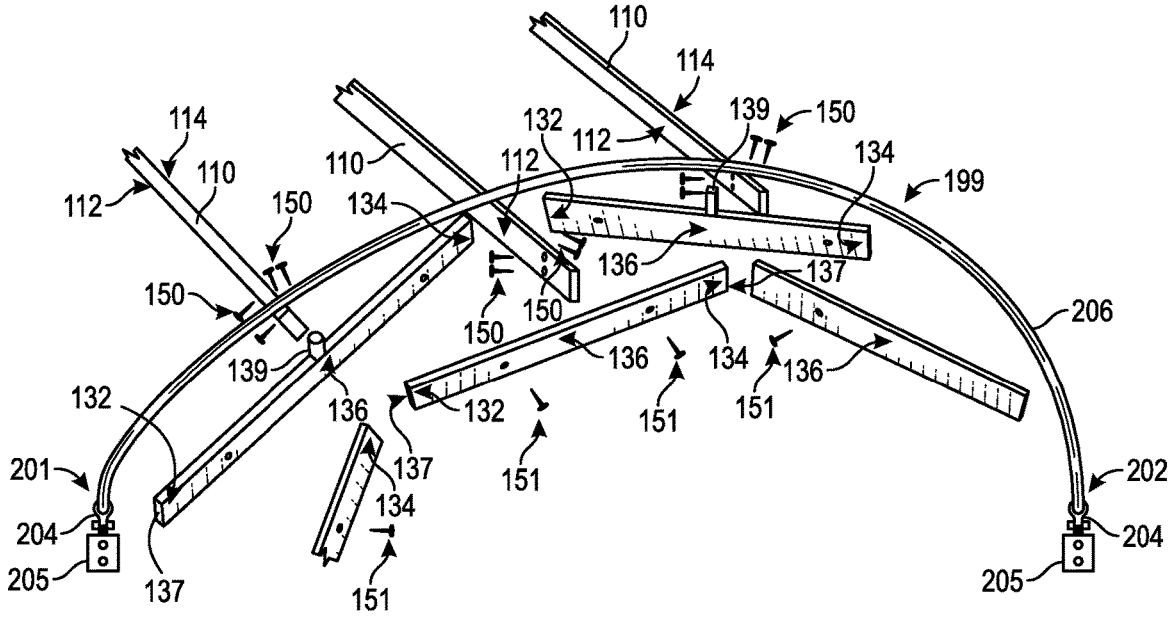
FIG. 4 is an exploded perspective view illustration of basic components of a radial arch structure.
Figure 5:
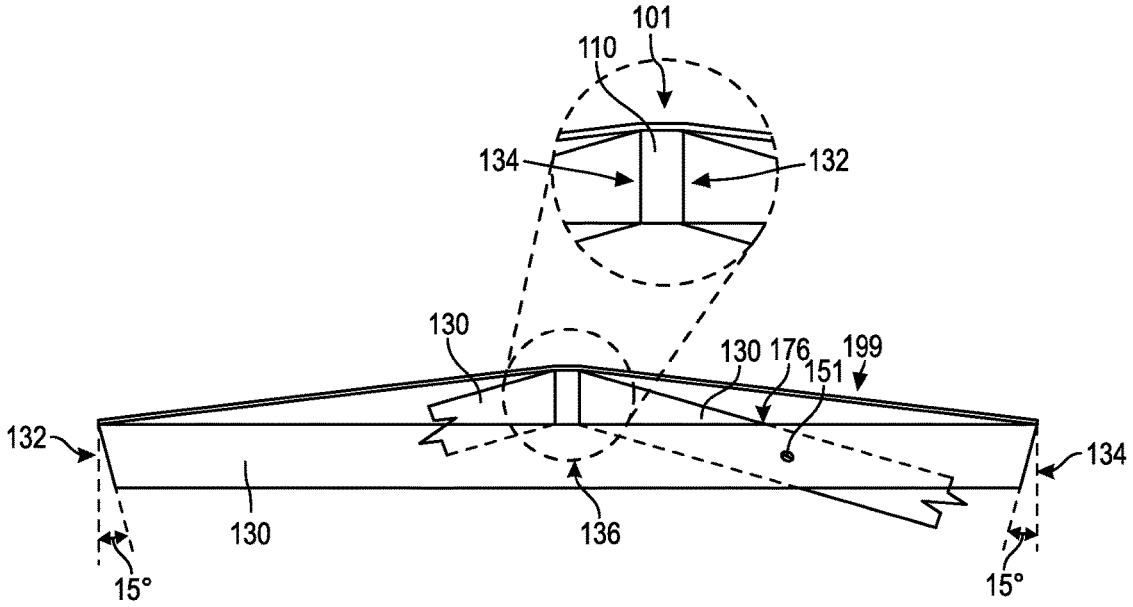
FIG. 5 is a front elevation view of sample members of a radial arch structure having an exemplary 15° orientation to form a radial arch structure portion comprised of relatively smaller gage materials.
Figure 6A:
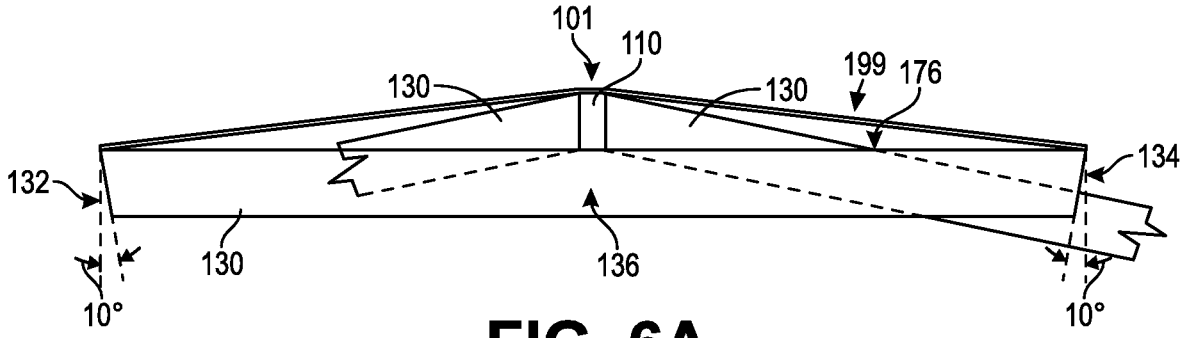
FIG. 6A is a front elevation view of sample members of a radial arch structure having an exemplary 10° orientation to form a radial arch structure portion comprised of smaller gage materials than those of FIG. 5.
Figure 6B:
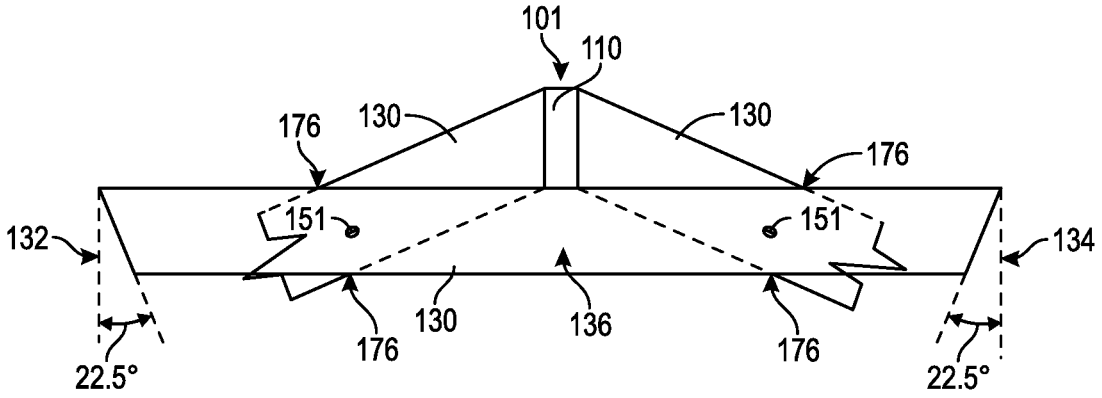
FIG. 6B is a front elevation view of sample members of a radial arch structure having an exemplary 22.5° orientation to form a radial arch structure portion comprised of larger gage materials than those of FIGS. 5 and 6A.
Figure 6C:
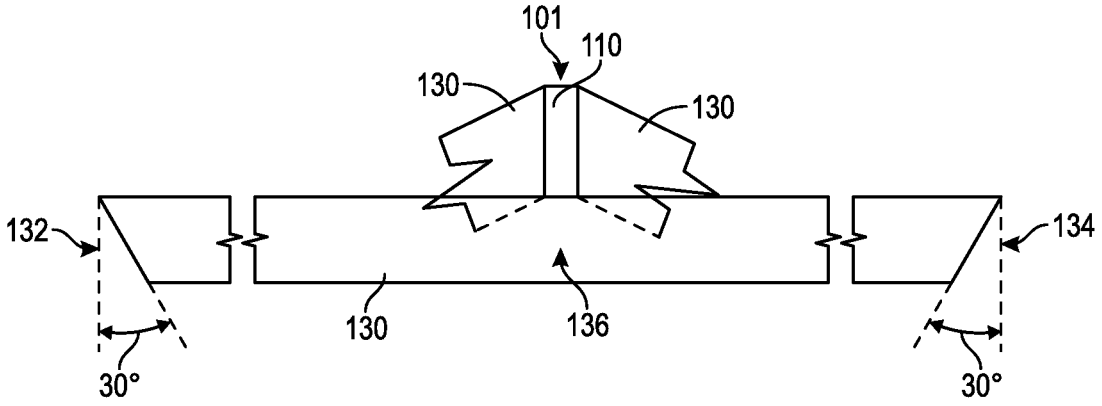
FIG. 6C is a front elevation view of sample members of a radial arch structure having an exemplary 30° orientation to form a radial arch structure portion comprised of still larger gage materials than those of FIGS. 5, 6A, and 6B.

The radial arch structures 100, 100', 100", 100'" thus comprises a plurality of elongated rectangular intermediate cross-section stringer members 110 (or compression stringer members 802 of FIGS. 7, 8 and 14), each stringer member of the plurality of stringer members comprising opposing first and second side surfaces 112, 114 lying in substantially parallel planes, and a plurality of intermediate elongated rectangular cross-section arch members 130 (or arch members 130' of FIGS. 7 and 14) each of the plurality of arch members having a midpoint 136 and first and second opposing angled ends 132, 134 of equal but opposing to one another angular magnitude (e.g., in angular patterns that evenly divide into 360°, such as 15°, −15°; 10°, −10°; 22.5°, −22.5°; 30°, −30° as shown in FIGS. 5-6C) the ends of each of the plurality of arch members being shaped to be adapted to converge crossways on, and completely abut as a flat surface 137 (as seen in FIG. 4), so abutting without any step or notch in the arch member 130 or the stringer member 110 on a side surface 112, 114 of two non-adjacently positioned of the plurality of stringer members.

Figure 10:
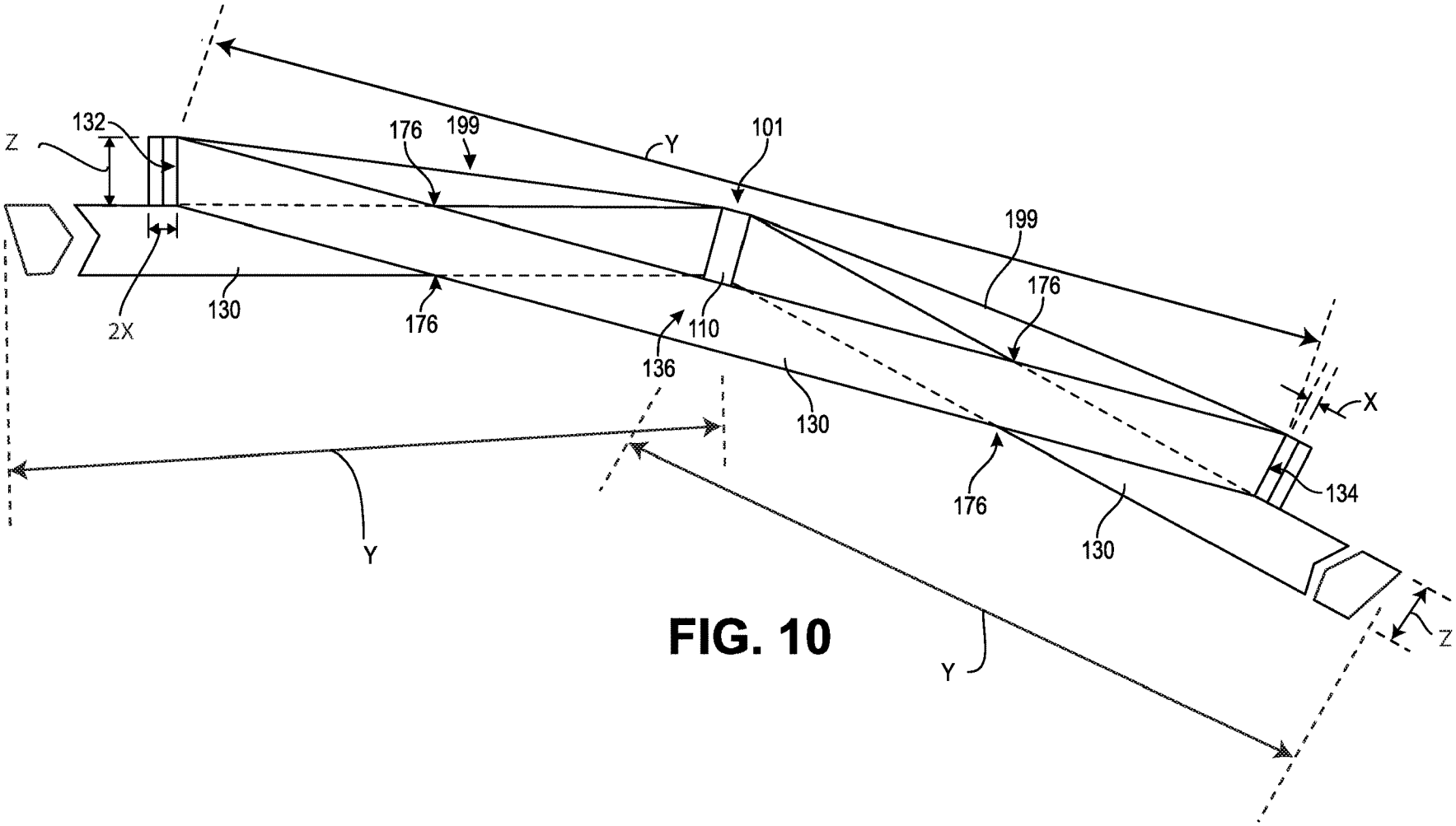
FIG. 10 is a front elevation view illustrating uniformly-sized and shaped (angled) members of a radial arch structure.

As can be seen in FIG. 10, because of the opposing angles cut on the ends of each arch member 130, (130' of FIGS. 7 and 14), each arch member has a longer upper edge with measurement Y, and a shorter lower edge. Thus, each arch member 130, 130' in a structure has the same dimension upper longer edge and the same dimension lower shorter edge, it being the case that each arch member also has the same magnitude, though opposing angled, cuts on each end thereof. Thus, any one of the arch members 130, 130' may be used as an undergirding member, and indeed each arch member does serve as an undergirding member.

To facilitate construction, each arch member 130 (as to arch structures 100, 100', 100" only) is further adapted for surface-to-surface interconnection at a mid-point 136 of each arch member and via a double-threaded lag bolt 139 (shown in FIG. 4) at preferably uniformly and evenly-spaced intervals (for visual aesthetics purposes) along a stringer member 110 (an upper surface of the arch member and an inner surface of a stringer member 110).

This interconnection is preferably accomplished by a spinning attachment construction method, wherein the distance between adjacent courses of arch members 130 are laid out (as further shown and described in connection with FIG. 17) as preferably slightly longer than half the distance of the long edge, measurement Y of the arch members. The arch members 130 are attached to the stringer members 110 at a location undergirding the stringer member, such attachment being accomplished via double-threaded lag bolts 139, for undergirding the stringer member. Each such interconnection point is located between two non-adjacently positioned stringer members and, again, at the mid-point 136 of each of the plurality of arch members 130.

In this way, construction of radial arch structures in accordance with one or more aspects of the invention is simplified. This is because multiple single stringer members 110, of say 12 feet long each (or even longer), may be laid on the floor, and undergirding arch members 130 may be spun onto double-threaded lag bolts 139 at each appropriately spaced interval for a course of arch members (again spaced at slightly more than half of the long-edge length of each arch member). This creates essentially a spine looking stringer member 110 with each undergirding arch member 130 being fixed perpendicularly thereto (like perpendicular ribs). As such, this resulting structure is ready for installation on the overall structure 100, 100', 100" in the form of separate chunks (or partially pre-assembled stringer member/arch member rows), moving from the base of the structure up to the top of the structure.

The sizes of materials, preferably standard-sized materials, to be used for the various radial arch structures 100, 100', 100", 100'" of the present invention are to be determined in part by the desired design for size and strength needed, and further by the number of points 101 to be defined around the radial arch. The number of points 101, in turn, are preferably determined by the number of evenly-divisible angles that are chosen to be within a given radial arch arc defined by a desired structure. Thus, generally speaking, and referring to FIGS. 5-6C, 10, and 16, it can be seen that the smaller the evenly-divisible angle chosen (e.g., evenly divisible into 90°, 180°, 360°, or whatever size arc of arch structure is to be constructed, and hence for opposing angled cuts on arch members 130, generally the lighter the gage of materials that are to be used.

Thus, for example, 1×1's may be used for 10° angle cuts and associated arcs, and 2×4's may be used for 15° angle cuts and associated arcs. For larger such evenly-divisible angles chosen, and their corresponding arcs, however, such as for 22.5° or even 30° angles and corresponding arcs, larger stock materials may be used. Thus, for example 2×4's and 2×2's may be used for 22.5° angle arcs, whereas for 30° angle arcs, 2×6's or 4×4's, are able to be used.

Thus, it can be seen that for structures requiring more load bearing capability, since larger gage stock materials would generally be required for such, the evenly-divisible angle chosen is to be greater, whereas the converse is also generally true for more delicate structures, where smaller stock materials would generally be appropriate and would generally allow staying within the constraints of the claimed invention and design. This is because as smaller-angle divisions are used, with more arcs and points 101, and hence more stringers 110 employed in such a case, there is a smaller angular space for the stringer to be fully undergirded (without any notches) by an undergirding arch member 130, 130' and still maintain an outermost surface of the stringer to be oriented so as to be on the imaginary arc defined by the structure 100, 100', 100", 100'". Thus, if too large of materials are used in conjunction with a smaller angle division (e.g., 4×4's with 10° arcs), such would not work in accordance with the invention without heavily notching the larger and heavier materials, thus weakening the integrity of undergirding arch members 130, and thus weakening the overall structure 100, 100', 100", 100'".

As shown in FIG. 4, the radial arch structures 100, 100', 100", 100'" further comprise a plurality of fasteners 150. The plurality of fasteners 150 are defined as any means used to interconnect the ends of each arch member 130 to a stringer member 110, 120 (or a compression stringer member 802 to an arch member 130), to interconnect two arch members together, or to interconnect two stringer members together, whether they be screws, nails, nuts, bolts, welds, clips, staples or brackets. The fasteners 150 are fastened in this way, and depending on the weight of, and the possibility of load bearing of, the arch structure 100, to make it fortified to be as if monolithic and thus capable of withstanding, without damage to the structure, sufficient gravitational weight and load-type forces, sufficient side-to-side shifting-type forces, and sufficient uplift-type forces. Such forces might result, for example, from lifting the structure 100 by a hook 10 (FIGS. 1 and 15) hanging from straps, or chains, 11, from a crane 12, or helicopter (not shown) on, or adjacent, an upper portion of the structure. Thus, it will be apparent that heaver structures 100, 100', 100", 100'" made of heavier materials, may require more robust fastening to be considered as if monolithic, that is capable of even being lifted from a single upper point by a crane. Thus, while it will be appreciated that while a lighter-weight, more delicate, less suitable for bearing larger loads, structure may be fortified sufficiently to be as if monolithic without post-tensioning, such post-tensioning may be preferred for heavier material structures, and especially those intended for greater loadbearing purposes, to render such as if monolithic in such cases. Therefore, it will be apparent that whether or not a structure 100, 100', 100", 100'" is considered as if monolithic or not would be determined on a case-by-case basis depending on the weight of the materials of the structure and the load-bearing anticipated purposes for the structure.

As shown in FIG. 4, holes may be pre-drilled on materials (arch members 130 and stringers 110) for receiving and retaining fasteners 150. Further, it will be appreciated that a first abutment of arch member 130 to stringer 110 may be fastened by screwing or nailing, for example, fasteners 150 directly into the end 137 of the arch member from an opposite side or 114)) of the stringer than that to which the arch member abuts (i.e., screwing through the stringer 110 and then the end 137 of the arch member). Then, when a second arch member 130 is abutted into the opposing side (114, or 112) of the stringer 110 and opposite the first arch member 130 abutment and attachment thus attached, fasteners 150 are preferably screwed at an angle from the opposing side of the stringer and into the end of the second arch member. Where brackets 150 are used, they may be mounted to abutting arch members 130 and same side surfaces 112, 114 of stringers 110.

As shown in FIGS. 1, 2, 3, 11, 12, and 13, such a radial arch structure 100, 100', in accordance with this aspect of the invention may, in an embodiment, comprise a portion of the structure defining a radial curve defining the points 101 of an incomplete circle, or in other words an arc, part, or portion, of a circle, further comprising a plurality of end stringer members 120, end arch members 140, special arch members 145, and wall-stud members 170. Each of the plurality of stringer members 110, other than the plurality of end stringer members 120, is in such a case an intermediate stringer member, and each end stringer member 120 is positioned crossways of respective corresponding arch members 130, 140, 145, and 170.

Each of the plurality of arch members 130, each of the plurality of end arch members 140, each of the plurality of special arch members 145, and each of the plurality of wall stud members 170, has a first end 132, 142, 146, 172, respectively, and a second end 134, 144, 148, 174, respectively, the first end of each of the plurality of arch members, end arch members, and special arch members, having an angle adapted for fully abutting the end surface 137, to the maximum degree possible given chosen material sizes, to side surface 112, 114 without any steps or notches, with a one of the plurality of intermediate stringer members 110 or end stringer members 120.

The second end 134, 144 of each of the plurality of arch members 130, 140, respectively, comprises an opposing angle of equal angular magnitude to the first end of the arch member and adapted for fully abutting flat-end-surface 137 to a flat-side-surface 112, 114 of a stringer member 110, or end stringer member 120, to the degree possible without any steps or notches.

The first end 146 or 172 of a special arch member 145, or of a wall stud member 70, respectively, has either an angle adapted for the use thereof as a wall stud or an anchor for a foundation, or an angle adapted for fully abutting flat-end-surface 137 to a flat-side-surface 112, 114 of a stringer member 110, or end stringer member 120, to the degree possible without any steps or notches. The second end 148 or 174 of a special arch member 145, or of a wall stud member 170, respectively, has either an angle adapted for use thereof as a wall stud or an anchor for a foundation, or an angle adapted for fully abutting flat-end-surface 137 to a flat-side-surface 112, 114 of a stringer member 110, or end stringer member 120, to the degree possible without any steps or notches. In the case of a wall stud member 170, the wall stud member bypasses one of the plurality of end stringer members 120 and thus ties the radial arch structure 100' into either an anchor point foundation ISO as shown in FIG. 3A, or a wooden foundation, or foot, 180 as shown most clearly in FIG. 11.

Each of the end arch members 140 and the intermediate arch members 130 are further oriented in scissor-like crossing relationship as shown at 176 to another of the plurality of end arch members and intermediate arch members. Preferably, each of the end arch members 140 and intermediate arch members 130 are further interconnected with fasteners 151 (see FIG. 4) at their scissor-like crossing junctions or locations 176.

Figure 2:
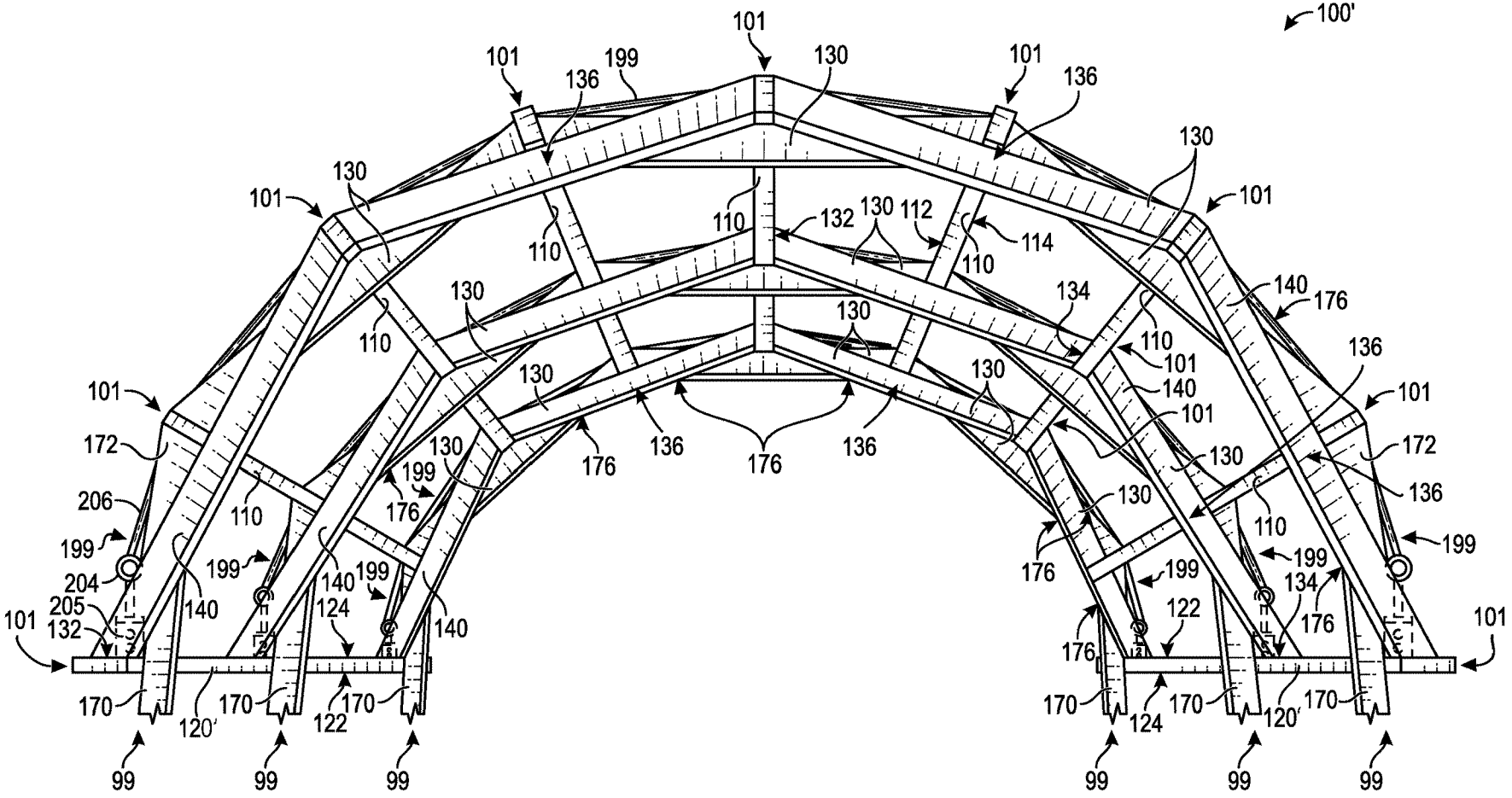
FIG. 2 is a perspective view illustration of another embodiment of the invention showing a half-tube radial arch structure having members fastened together with fasteners and employing a plurality of tensioning members for creating an arch structure for example for a building, a trellis, a greenhouse, or a garden framework.
Figure 3A:
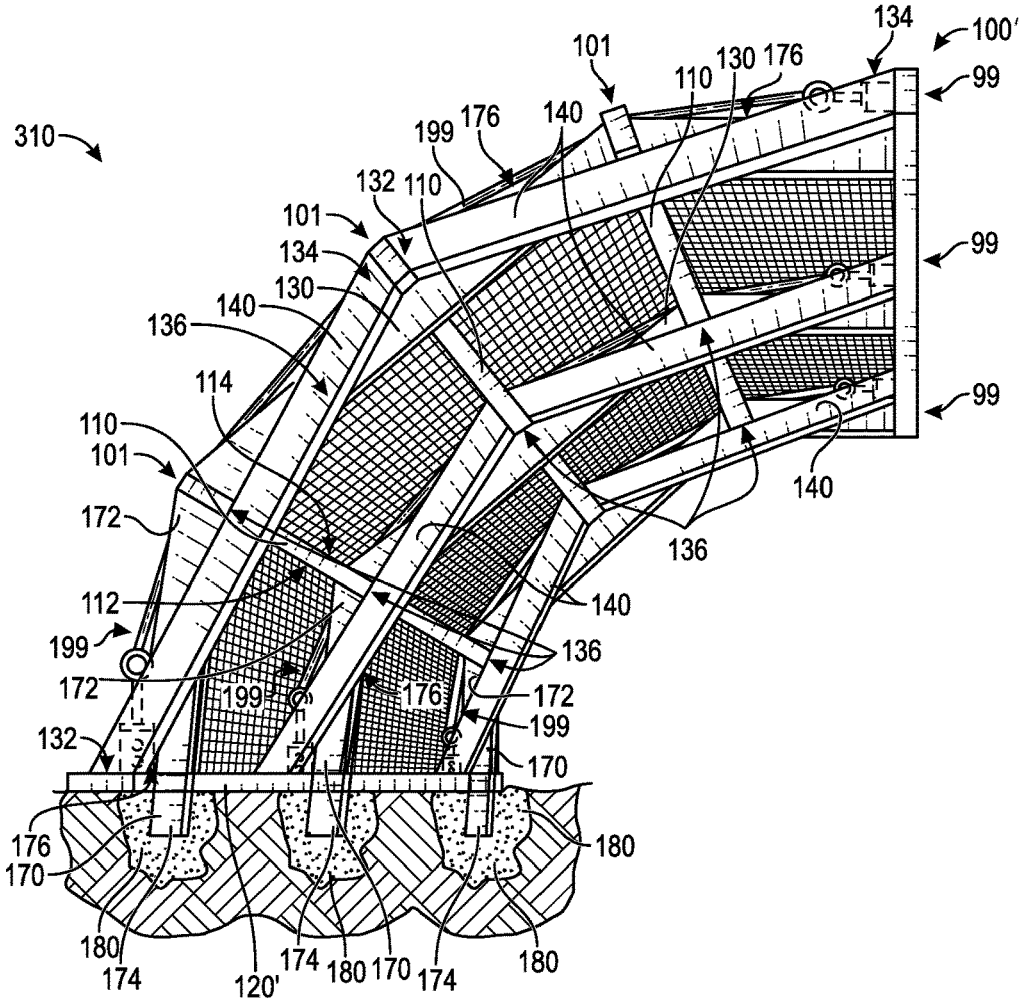
FIG. 3A is a perspective view illustration of another embodiment of the invention showing a radial arch structure having members preferably fastened together with fasteners and employing a plurality of tensioning members for creating a shade structure that is anchored by a foundation.

As shown in FIG. 4, each of the arch structures 100, 100', 100", 100'" may be fortified to be rendered as if monolithic with the provision of at least one tensioning member 199, and preferably a plurality of tensioning members 199 as shown in FIGS. 2, 3A, and 7, with there preferably being provided one tensioning member for each course of a plurality of arch members 130, 130'. As can be seen in FIG. 3A, there are three courses of plurality of arch members 110, and hence preferably three tensioning members 199 as shown. Further, as can be seen in FIG. 2, there are also three courses of plurality of arch members 110, and hence preferably three tensioning members 199 as shown.

Still further, as can be seen in FIG. 7, there are four courses of plurality of arch members 110 as part of the main (semi-tubular) portion of the greenhouse 700, and hence preferably there are four tensioning members 199 as shown for that portion of the greenhouse. However, it will also be apparent from FIG. 7, that there are additional post-tensioning members 199 associated with an at least partially-domed add-on structure 750, which at least partially domed structure will be further described hereinafter in connection with FIGS. 8 and 14.

Still further, as can be seen in FIG. 15, there are four courses of plurality of arch members 130 as part of the tubular portion of the circular framework 100", and hence preferably there may be preferably provided four post-tensioning members 199. Such tensioning members 199 would tend to fortify, and thus render as if monolithic a, for example, wooden, or screwed/bolted-together aluminum, arch structure, where such tensioning would strengthen and solidify the structure to make it as if monolithic.

And while it may be appreciated, however, that such tensioning of any structure 100, 100', 100", 100'" may not be considered necessary, for example in the case of a steel welded structure, where fastening means in the form of welds, or nuts and bolts, between arch members and stringer members, and further with fastening means between arch members with scissor-type crossing corresponding arch members, wherein such may be considered sufficient to render the structure as if monolithic without any tensioning member 199 (assuming a lighter-weight, less-load bearing-type structure), it will nevertheless be appreciated that addition of compressive forces by adding tensioning members 199 may still be desirable to even further strengthen the structure to make it more capable of withstanding otherwise destructive forces. Such may be considered important to add factors of safety where catastrophic ends may obtain upon failure of a structure that is otherwise non-fortified in this way with tensioning members 199. In any event, manufacturers and users are advised that any structure made with the present invention is to be thoroughly designed and tested for engineering strength to perform intended functions safely while accounting for reasonably anticipated environmental conditions with appropriate factors of safety.

Each post-tensioning member 199 preferably comprises at least one tightening member, such as a threaded eyeloop-type member, a turnbuckle-type member, a ratchet-type member, etc. (but tightening members may also be employed on both ends of the cable) for tightening, and thus applying tensioning to the wire cable 206, and extending from mounting brackets 205 on either end of the cable 206, for allowing fastening of each tensioning member to an appropriate stringer member 110, 120, 120' or arch member 130, 140, 145 as is known. Each tensioning member is preferably linearly oriented and aligned along a given longitudinal circumferential line 99 of each arch structure (as shown in FIG. 7), wherein along such line 99 there are longitudinally-oriented pluralities of intermediate arch members 110, end arch members 140, and special arch members 145 (where employed) as shown. Thus, there is preferably provided, where necessary, at least one tensioning member 199 for each such longitudinally-oriented plurality of arch members.

Such tensioning member 199, or preferably plurality of tensioning members, each of the post-tensioning type, meaning that the tensioning member is preferably applied to a given arch structure after the structure is fastened together with fasteners. In this way, the tensioning member 199 is tightened and placed in tension, which in turn puts at least a part of the arch members 130, 140 of the arch structure in compression, thus compressing each arch member so that it presses onto corresponding stringer members 110, 120 to which each arch member is attached. Such post-tensioning further strengthens the integrity of the arch structure 100, 100', 100", 100'" and thereby makes the structure more fortified as if monolithic and thus capable of withstanding, without damage to the structure, sufficient gravitational weight and load-type forces, sufficient side-to-side shifting type forces, and sufficient uplift-type forces, all sufficient in the sense that they would meet engineering and architectural standards, and as for example resulting from lifting the structure by a hook adjacent an upper portion of the structure, or for example during winds or earthquakes.

Thus, where higher-stress, higher load-bearing, and typically heavier structures 100, 100', 100", 100'" are desired, post-tensioning members 199, 799 may be employed to fortify the structure to render it as if monolithic. And where such structures may be inaccessible, or to some degree inaccessible, thought is to be given to the degree to which such structures should be comprised of wood, or pressure treated lumber, versus aluminum, steel, or other suitable material, which may be coated, treated, padded or guided with tracks or implements to prevent the breakdown of whatever material is chosen suitable for a given application. Regardless of the materials chosen, however, it will be appreciated that the structure may be possibly further fortified to be made more as if monolithic with post-tensioning, especially since in the present case, and in accordance with an aspect of the invention, the post-tensioning herein serves to lend integrity to the structure in a way that compresses arch members 130, 130' and/or stringer members 802, with multi-directional static forces aligned at least partially along such non-unidirectionally-oriented members (i.e., along arch members or stringer members oriented to approximate a radial arch curved surface) and partially terminating and opposed on and at fully abutting angled ends thereof on side surfaces 112, 114, and side surfaces 708, 710 of arch members 130', respectively, to distribute such forces throughout the structure and thereby render the radial arch structure 100, 100', 100", 100'" fortified to be as if monolithic.

As can be most easily seen in FIG. 4 (and FIG. 2), each at least one tensioning member 199 has a first end 201 and a second end 202, and each end of each at least one tensioning member 199 is fastened to one of a stringer member 110, such as an end stringer member 120 in the case of a partial circle cross-section type arch structure 100', and one of the end arch members 140. Each at least one tensioning member 199 extends along each of the defined points 101 of the radial curve defined by the arch members 130, 140, 145 of the arch structure, each at least one tensioning member being capable of being tightened such that, together with the fasteners 150, 151, the arch structure is made fortified to be as if monolithic.

The at least one tensioning member 199 of this aspect of the invention may be applied to the arch structure whether it is a part-of-a-circle-type of arch structure 100, 100', whether it is a complete-circle-type of arch structure 100", or whether it is an at-least-partially-domed-type of arch structure 100'". However, it will be appreciated that technically there is no beginning, or end, stringer members with a complete-circle-type of arch structure 100", therefore, it will be appreciated that the ends 201, 202 of each at least one tensioning member 199 may be attached to one, or more, intermediate stringer members 130 in that case.

Each at least one tensioning member 199 may also extend past an end stringer member 120 (e.g., as shown in FIG. 7) and further interconnect the arch structure 700 beyond the end stringer member, for example to a second end 174 of a wall stud stringer member 170, alternatively with the at least one foundation member 180 of the arch structure 100', or the end stringer member 120 of the arch structure 100. In this way, the semi-circular (in cross-section) arch structure 101', 100, the shade structure 310, the arched trellis arbor structure 1100, and/or the barracks structure 1300, are further fortified and thus rendered as if monolithic, since, for example, the entire structure could now be picked up from above by a crane hook 10. Yet further, it will be appreciated that the at least one tensioning member 199 may be applied to a complete circular cross-section arch structure 100" framework, for example in the case of an elongated tubular hypertube structure framework 1500 of FIG. 15. Such tensioning members 199 may also be applied to either a complete circular cross-section arch structure 100" framework, or a partial circular cross-section arch structure 100, 100' framework, for an elongated flotation device 1200.

Note that regarding a barracks structure 1300, for example, or a hypertube structure 1500, stringer members 110 may be elongated by overlapping ends of adjacent stringers to make a longer structure than would otherwise be the case, all without departing from the broader aspects of the invention as claimed. Thus, the length of a semi-circular arch structure 100', such as a barracks structure 1300, or a tube structure 100" (1500) is not limited, since additional arcs of stringers may be continued along, and this is true despite variations in the land on which the structures are to be built (e.g., along rolling hills), since the structure can conform to such variations in the land with relative ease, it being the case that the height of the structure is always equidistant from the foundation, or land underneath the structure, at each point of the structure along its longitudinal length.

In the case of a part circular cross-section arch structure 100', the at least one tensioning member 199 may be applied with each end 201, 202 of the tensioning member 199 attached to an end stringer member 120, 120', the tensioning member thus, upon tightening, rendering as if monolithic the part circular cross-section structure.

Referring to FIG. 7, each of the tensioning members 199 are only partially shown, and indicated with a break line near a bottom portion of the structure, for clarity of the Figure.

Each of the various types of arch structures 100, 100', 100", 100''' set forth, whether partial-circle-type 100, 100', complete-circle-type 100", 180-degree-semi-circle-type 100, combined-wall-stud-and-partial-circle-type 100', or at-least-partial-dome-type 100''', may be strengthened and fortified in its structural integrity and monolithicness with at least one, and preferably a plurality, of tensioning members 199. It will be appreciated by those skilled in the art that, as tension is applied to each tensioning member 199, this in turn creates compressive forces within individual arch members 130, 140, 145, and to a lesser degree stringer members 110, 120, thus tending to solidify the overall arch structure 100, 100', 100", 100''', and any included bound wall stud members 170 and foundation members 180, into an integral structure.

Figure 12:
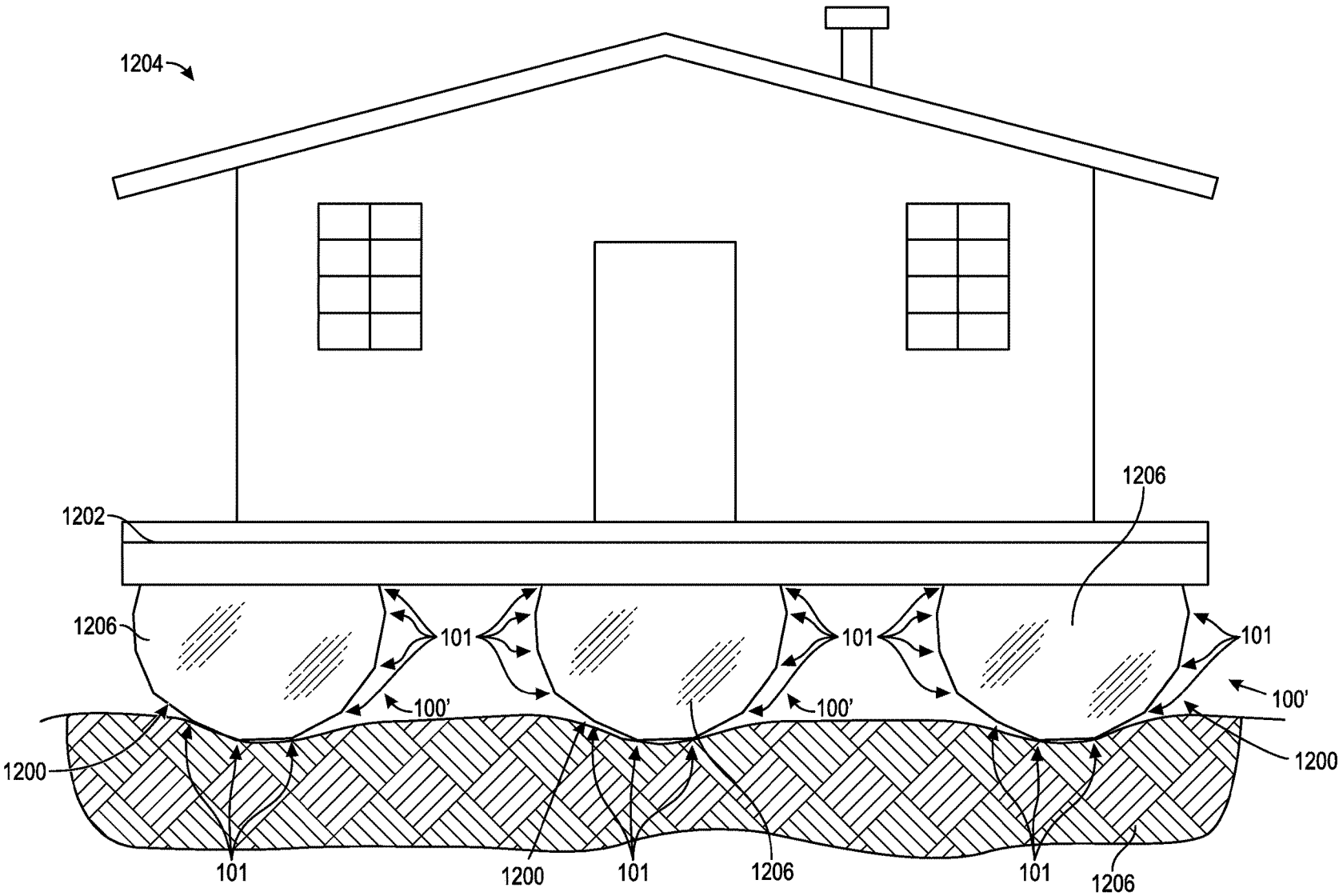
FIG. 12 is a front perspective view of a platform supported with a plurality of preferably-post-tensioned and therefore fortified as if monolithic elongated flotation structures made with sealed covered partial-tube radial arch members.

Thus, the arch structure 100 and 100', of FIGS. 1 and 11 respectively, may be such that the cross-section of parts of the structure defining a radial curve define the points 101 of an 180-degree semi-circle, whereas the arch of the structure 100' may be such that the cross-section of parts of the structure defining a radial curve define the points 101 of less than a 180-degree semi-circle as shown in FIG. 3A, or more than a 180-degree semi-circle as shown in FIG. 12.

In, for example, arch structure 100 of FIG. 1, the plurality of end stringer members 120 may comprise two end stringer members 120 of wider width, for capping the arch structure 100, each end stringer member being positioned at diametrically opposed locations on a defined semi-circle. Thus, it can be seen in FIG. 1 that arch structure 100 further comprises a plurality of special arch members 145, each special arch member having a longitudinal axis, a first end 146, and a second end 148. The first end 146 of each special arch member 145 has an acute angle adapted for fully abutting, flat end surface (of the special arch member) to flat side surface (of an intermediate stringer member) to the degree possible, with one of the plurality of intermediate stringer members 130, the second end 148 of each special arch member having an angled surface adapted for fully abutting to the degree possible (for that angle cut) flat end surface (of the special arch member) to side surface (122 of a widened end stringer member).

Further, as can be seen in FIG. 1, each of the second ends 144 of each end arch member 140 comprises an opposing angle of equal angular magnitude to the first end of the end arch member and adapted for fully abutting flat end surface (of the end arch member 140) to flat side surface 122 (of the end stringer member 120), to the degree possible without any steps or notches, of one of the plurality of end stringer members. Each of the plurality of end arch members 140 and the plurality of special arch members 145 are oriented in scissor-like crossing relationship to another (as shown at 176) of the plurality of end arch members and the plurality of special arch members.

Still further, the end arch members 140 and the special arch members 145 may also be interconnected with fasteners 151 at those locations 176 at which they cross in scissor-like fashion to further solidify the integrated structure 100.

The arch structure 100 of FIG. 1 may be made of steel arch members 130, 140, 145, members welded together with stringer members 110, 120, since the structure is considered as if monolithic, but it may also be possibly constructed of wood members if sufficiently small and capable of as-if-monolithic-type structural integrity if constructed with just fasteners. However, it will be appreciated for greater structural integrity, preferably tensioning members 199 will be used a further described herein, and to render the structure more fortified as if monolithic. As further described below, such an arch structure 100 may be used to create, for example, a form for pouring reinforced concrete to create an underground subway, or tunnel, structure, or any other load-bearing structure such as a support truss for a bridge, or a building, or other load-bearing structure.

As shown in FIG. 15, there is shown an arch structure 100" in the form of a section of a tubular structure 1500, wherein the cross-section parts of the arch structure defining a radial curve define the points 101 of a full circle, and wherein each of the plurality of stringer members is an intermediate stringer member 110. This is because, as is generally understood, there is technically no beginning and no end to a circle. Accordingly, and still further, each of the plurality of arch members of the arch structure 100" is an intermediate arch member 130, each of the plurality of intermediate arch members further being oriented in scissor-like crossing relationship, as shown at 176, to another of the plurality of intermediate arch members.

As with other embodiments of the invention, the intermediate arch members 130 may be fastened with fasteners 151 to their corresponding respective scissor-crossing intermediate arch members 130 to further solidify the integral arch structure 100". Further, as with other embodiments of the invention, each arch member 130 is also fastened with fasteners 150 at each end 132, 134 of each arch member to a stringer member 110 to make the structure 100", 1500 as if monolithic.

As shown in FIGS. 2, 3A, and 11, there is provided an arch structure 100' similar to that described above in relation to the embodiment 100 of FIG. 1, regarding a part, or arc, of a circular arch portion. However, as to arch structure 100', each of a plurality of end arch members further comprises an integrated wall stud member 170 (or alternatively as shown in FIG. 3A, an integrated extension member used for anchoring the structure 100', 310), integrated in the sense that each wall stud member bypasses at least one of an end stringer member 120' to become both part of a wall, or other integrated extension (in the case of FIG. 3A), and the arch structure 100'. In this way, ties, such as Simpson® Brand ties, may not be needed to make the resulting structure 100', 310, 1100, earthquake proof.

Further, in the case of arch structure 100', the arch structure further comprises at least one foundation member 180, and the first end 172 of each wall stud member 170 abuts full end surface to side surface 112 of the next adjacent intermediate stringer member 110 to the end stringer member 120', and the second end 174 of each at least one wall stud member 170 is connected to a surface 182 of the at least one foundation member 180. Or, alternatively as shown in FIG. 3A, the second end 174 of the wall stud members 170 may be embedded in a concrete foundation 180.

As shown in FIGS. 1, 2, 3A, 7, 12, 13, and 15, the various arch structures 100, 100', 100" of the invention may be suitably and even advantageously used for various different types of structures or applications. Thus, in accordance with this aspect of the invention, the arch structure 100 shown in FIG. 1 may be suitably used as a slip form framework able to be carried by a crane boom 12 of a tractor crane 14 for insertion into an earthen tunnel structure 18 in accordance with known methods for making subway tunnels. In such a case, most likely the points 101 preferably define a 180-degree circular arc in cross section, but it will be appreciated that other arcuate angular degree's of partial circles may be used without departing from the invention as claimed. Further, while not necessary to be as if monolithic as defined herein, it will be appreciated that further bracing may be added to the structure as may be considered necessary by structural engineering review and permitting. In other words, this specification is not intended to be an engineering document, but rather teaches structures considered commercially suitable for various uses, and preferably such structures are well-suited for post-tensioning for fortifying the radial arch structures 100, 100', 100" to render them more fortified to be as if monolithic.

Figure 3B:
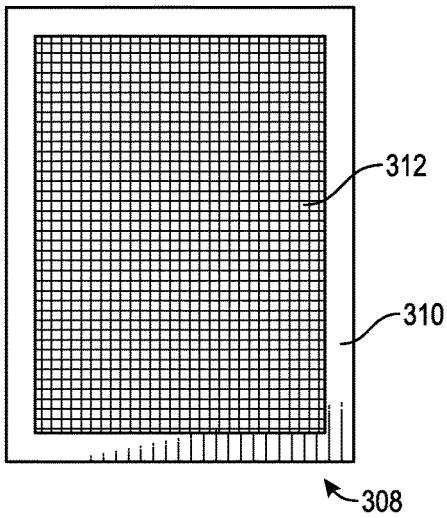
FIG. 3B is a plan view illustration of a standard frame and shade screen member fit for a void portion of a radial arch structure.
Figure 3C:
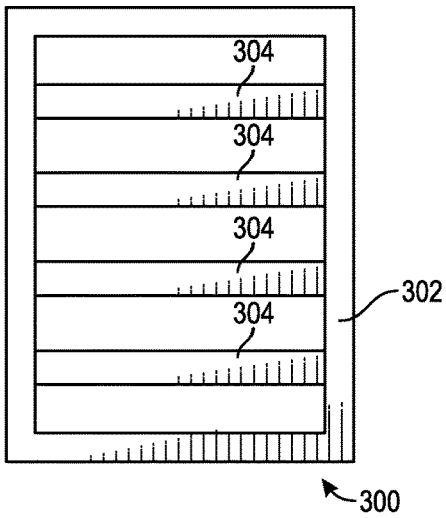
FIG. 3C is a plan view illustration of a standard frame member for providing a base for sheeting and fit for a void portion of a radial arch structure.

In accordance with this embodiment of the invention 100 used for a slip form framework as shown in FIG. 1, and in accordance with another aspect of the invention, it may be easily seen that the invention may further comprise a plurality of sheeting frames 300 as shown in FIG. 3C. Each sheeting frame 300 comprises a standard-sized rectangular framework 302 and cross frame members 304. The standard rectangular framework 302 of each sheeting frame 300 is designed to fit snugly without any gaps in a standard-size opening 306 (the opening being shown in FIGS. 1 and 2) formed in each arch structure, whether arch structure 100, 100', or 100". Therefore, it will be appreciated that each of these sheeting frames 300 may be employed to accomplish enclosing the arch structure, as would be desirable for example to create a slip form for pouring of cement onto the structure to form a reinforced subway tunnel, for example. However, it will be appreciated that such sheeting frames 300, or sheeting in general, is not necessary to make the present structures 100, 100', 100" as if monolithic.

As shown in FIGS. 2, and 7, the structure 100' may be suitably and advantageously used as an open, as-if-monolithic garden structure, or a greenhouse 700. In the case of an open garden structure, it will be appreciated that netting, chickenwire, or even chain link, may be applied to the openings 306 in order to keep animals, insects, or others out of the structure 700. Such netting may take the form of a screened shade frame member 308 as shown in FIG. 3B, wherein the screened shade frame member further comprises a standard-sized rectangular frame structure 310 and screen or netting material 312 fastened to the frame in a known manner. Such a structure 700 has the advantage of being able not only to keep destructive animals out of a garden enclosure, but also of providing a structure to hang grow lamps, watering systems, scare-crows, gazing balls, hanging baskets, and other such accessories.

In the case of a greenhouse 700, it will be appreciated that instead of netting or screening 312 for each of the frame structures 310, there may be employed glass or plexiglass 702 for creating a greenhouse-type environment. Such frame structures may be premade with glazing and aluminum or wooden frames, as is known in the art, and installed in the openings 306 of the semi-circular structure. Thus, for a more secure structure 700 as against the elements, perhaps for example for a glass housing type structure wherein persons may live, glass may be installed into frame structures similar to that of frame structure 310, perhaps with fewer, or no, cross members 304 (i.e., more like frame structure 308, made of wood, aluminum, steel, or other suitable material, and together with glazing in a manner known by persons skilled in the art of applying glass (or plexiglass) to structures. Or alternatively, for a less secure structure 700 as against the elements, as may be appropriate for a standard greenhouse wherein some airflow may actually be desirable, the present radial arch structure 700 provides an appropriate structure from which to hang standard hooks (not shown) for fastening glass, or plexiglass, panes in an overlapping manner (to allow proper venting), as is also well-known by persons skilled in the art of building greenhouses. And for further load-hearing capacity, such structure may be further fortified with post-tensioning members 199, 799 to render the same more as if monolithic to enable moving the same with a crane, for example, hanging from a centrally located upper hook, for example, and so as to be able to bear greater loads, whether from snow, winds, hanging of water barrels for field showers or watering, etc.

As shown in FIGS. 2 and 11, the structure 100' may be suitably and advantageously used as an arbor trellis 1100. In such case, the openings 306 of the arch structure 100' are suitable for crawling or creeping vines, and for providing support for other foliage. Such a structure is appealing to the eye and suitable for enhancing a garden or for use in photographs for weddings and other outdoor occasions.

Figure 13:
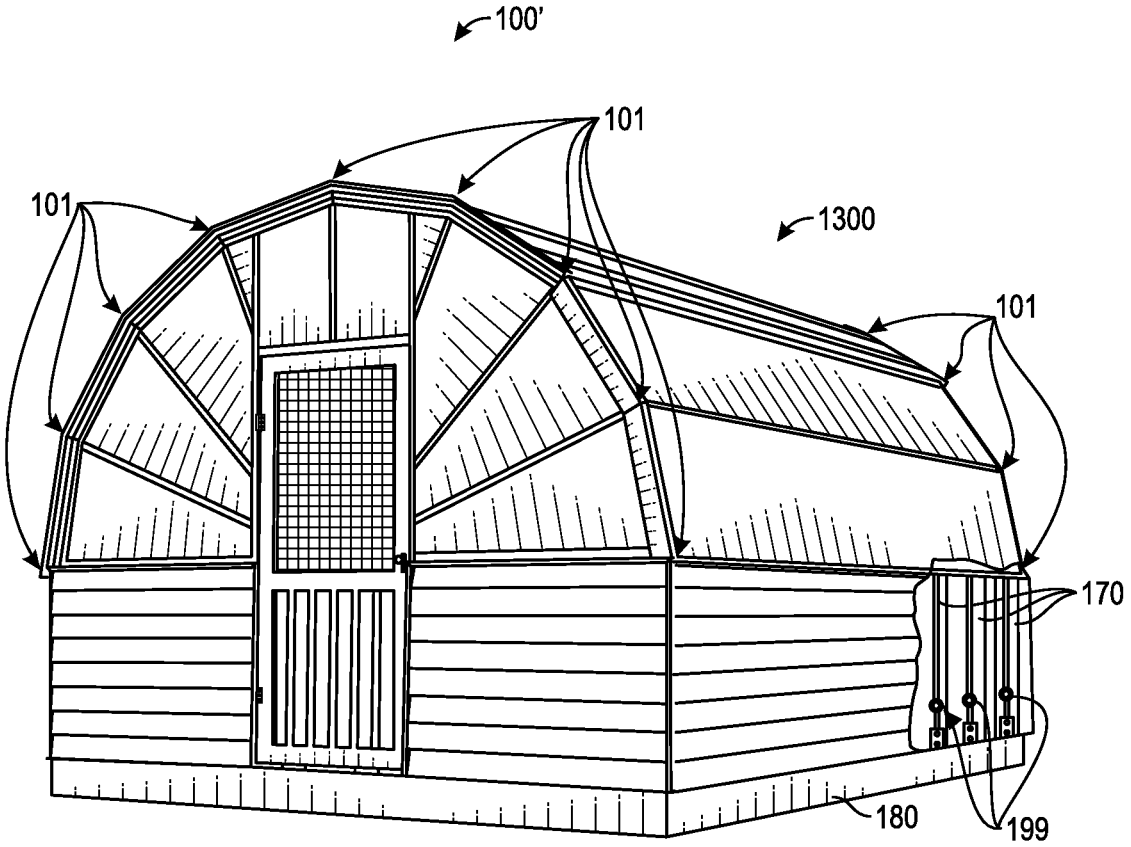
FIG. 13 is a barracks-type fortified to be as if monolithic structure having a roof portion made of a half-tube radial arch structure in accordance with an aspect of the invention, with the radial arch structure supported on and interconnected integrally with walls and post-tensioning extending from and connected to a foundation member, and optionally a floor, the structure also having a doorway at one end.

As shown in FIGS. 2 and 13, the structure 100' may be suitably and advantageously used as a frame structure for a barracks or a smoke house 1300. Such a structure may comprise integrated wall stud members fastened to a foundation member 180 as described previously in connection with FIG. 11. Such a structure may be completed with sheeting frame members 306, screened shade frame members 308, windowed frame members 702, or any combination of any of these. Further, a door 1302, end walls and paneling 1304, and tensioning members 199, may be included as shown in FIG. 13.

Or, as shown in FIGS. 1 and 12, the structure 100 may be suitably and advantageously used as frame structures for elongated flotation devices 1200 for supporting a raft-type foundation 1202 for supporting a floating house 1204 on the water 1205. In such case, the partially circular framework 100 as shown in FIG. 1 or 12, or even a fully circular framework 100" as shown in FIG. 15, may be sheeted at openings 306 with sheeting frames 300, and capped as shown at 1206 on ends of each elongated flotation device 1200, to form an enclosure for installing closed-cell foam for added flotation.

Such a structure 1200, it will be appreciated, represents a very great cost savings over current practices for such flotation devices comprised of full length cedar log timbers or sealed metal drums. Thus, while such a structure may be made of an arch structure 100' (i.e., a less than complete circular structure) or as a filled tubular enclosure made of an arch structure 100" defining a complete circle (i.e., 360-degrees) in cross section. Such arch structures 100, 100" thus may used as frame structures for the elongated hull of flotation devices 1200. Such devices 1200, of course, may preferably comprise a plurality of fasteners 151 to interconnect scissor-crossing arch members as described previously (in addition to fasteners 150 to interconnect arch member ends and stringers), and may also further preferably comprise a plurality of tensioning members 199 along the radial arch members as described previously.

Still further, as shown in FIG. 15, there is provided an arch structure 100" of an embodiment having points 101 defining a complete circle in cross section, wherein the arch structure forms a frame structure for an elongated above-ground tube framework 1500, as may be supported to form the structure for a hypertube transport structure employing vacuum or other high-speed transport technology. Such a structure 1500 preferably comprises a plurality of fasteners 150 to interconnect arch members and stringer members as described previously, as well as fasteners 151 to further interconnect scissor-crossing arch members. Still further such a structure 1500 may also further preferably comprise at least one, but preferably a plurality, of tensioning members 199, all as described previously.

As shown in FIG. 3A, there is provided an arch structure 100', wherein cross-section parts of the structure define points 101 of less than a complete circle (e.g., 90 degrees of a circle), and wherein the arch structure forms a frame structure for one of a sun shade, awning, rain shield, or other similar structure 310. The structure 310 comprises integrated wall stud members 170 (otherwise known as integrated extension members 170) extending past an end stringer member 120' and connected at each second end 174 of each wall stud frame member to a foundation member 180, otherwise known as concrete footings 180.

Thus, the present invention may be suitably used to create a diversity of radial arch structure products 100, 310, 700, 1100, 1200, 1300, 1500, whether of partial circular cross-section 100, 101', or of full circular cross-section 100", and such radial arch structures are not limited in size or strength by notches that have otherwise limited prior-art structures. Thus, such structures and products may be made with larger-gage wood, aluminum, steel, or other, materials and therefore be made to support greater loads. And despite this fact of larger materials to be able to support larger loads, the use of the fasteners 150, 151, and tensioning members 199, are employed where necessary, to render the structures fortified to be as if monolithic. Thus, even large structures may be picked up with hooks 10 applied dangling from a crane 12, 14, or other cable-type apparatus, connected to the structure at an upper lifting point 10, 13, or lifting points, in order to easily move the structure from place to place as may be needed for certain given applications.

Referring now to FIGS. 10 and 16, there are provided diagrams for assisting with understanding the uniformly-sized and standard materials aspect of the invention accounting for ease and low cost of manufacture, and further for understanding a method of laying out an arch structure in accordance with an aspect of the invention. Referring first to FIG. 10, it will be appreciated that intermediate arch members 130 are preferably all of the same shape (i.e., made of the same stock—such as 2×4's, 1×1's, 4×4's, or 2×6's—with the same opposing angular cuts on each end) and size (i.e., same inner and outer longitudinal lengths), making them easy to manufacture and use interchangeably while building a particular radial arch structure 100, 100', 100". Thus, as shown in FIG. 10, each intermediate arch member 130 is Y inches long at its longest length, 2× inches thick, and Z inches tall.

Referring now to FIG. 16 the steps of a method of laying out and designing a radial arch structure in accordance with one or more aspects of the invention are illustrated, comprising the following steps (wherein each designated step, a-h, corresponds to a portion likewise designated in FIG. 16):

a. Determine the size of the desired radius (r) and diameter ((d)=2×r) of your desired radial arch, and draw to scale the radial arch 1600 (in this case a semi-circle) on a piece of paper;

b. Plot as each a 22.5° points 101 (or other equidistant and evenly-divisible points for example at 10°, 15°, or 30° degrees) along the circumference of the semi-circle (with two end points at either end of the diameter of the semi-circle);

c. Connect every other point with chords;

d. Draw radial lines from the center point 1602 of the semi-circle to establish the center of the thickness of each stringer member;

e. Draw in the end view of a first stringer member at a plotted point (e.g., the 90° plotted point) along the circumference from step b., with proper dimensions (to scale) for stringer width;

f. Draw in an end view of other stringer members, e.g., at a next every-other point plotted in step b. (e.g., the plotted point that is the 45° position), and having been connected to the first stringer member of steps c. and e (e.g., the plotted point that is the 90° position) and with proper dimensions (to scale) for uniform stringer width;

g. Connect the upper corners and lower corners of each stringer to establish upper and lower lengths of each arch member; and h. Repeat steps e., f., and g, in order to draw in an end view of other stringer members at the other plotted points from step h and to connect the upper corners and lower corners to establish upper and lower lengths of each arch member (note: the height of each subsequently drawn end view of stringer members will be determined by the fact that each such stringer member is undergirded at a midpoint of, and by, an arch member.

i. Determine locations for attaching post-tensioning so as to be fixed at lower portions of the structure and so as to run along points 101 in order to create multi-directional static compressive forces at least partially terminating at abutting locations between stringer members and arch members (i.e., along arch members or stringer members oriented to approximate a radial arch curved surface) and to distribute such forces (compressive and tensile) appropriately throughout the structure to render it fortified to be as if monolithic.

Figure 17:
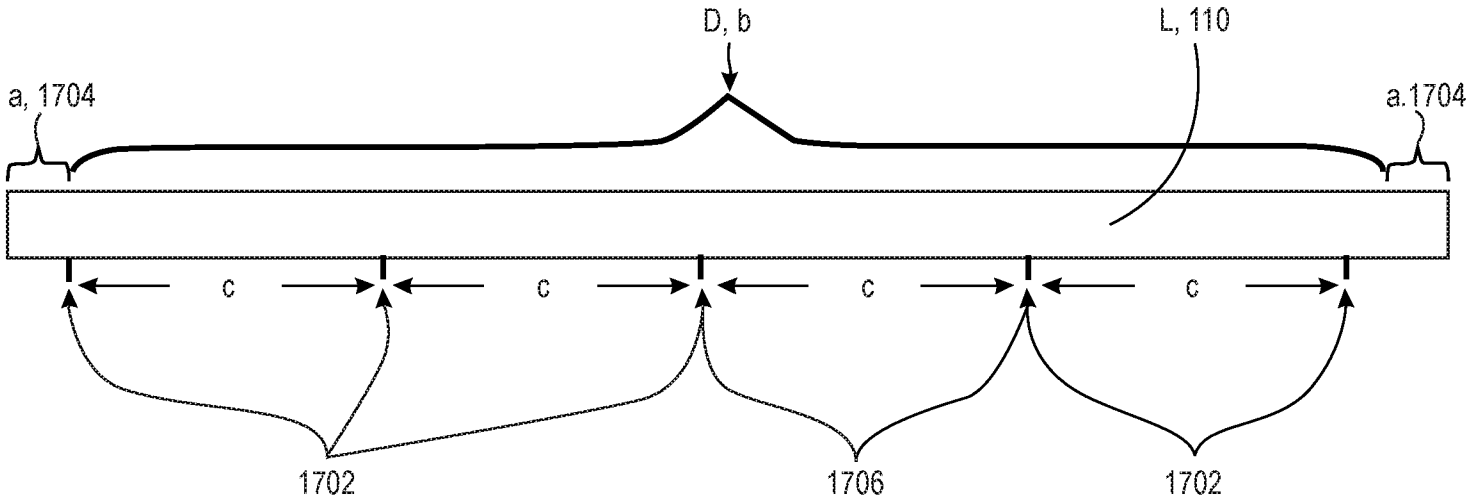
FIG. 17 is a diagram for assisting with explaining the method of laying out and designing an arch structure according to one or more aspects of the invention.

Referring now to FIG. 17, a preferred method for ease of construction to determine the layout distance and length of the centers 1702 of a desired number of arch member ribs (e.g., a linearly aligned plurality of arch members 130 forms a rib) positioned at points 1702 along a stringer 110 of a given length, comprising the steps of:

a. Take stringer length L minus (2×3 inches assuming 2×4's wherein each 2×4 is 1.5 inches thick and allowing three inches at the end of each stringer member as shown at 1704 to interconnect with other adjacent stringer members, if desired, to equal the available distance, D);

b. Divide the result D by the number of arch member ribs desired and centered at 1702, minus 1 (considering structural and load bearing purposes);

c. Choose a distance 1706 that is a little bit longer than V, the longer length of each arch member 130 (e.g., if the arch member longer length is 60 inches long, as determined above in connection with FIG. 16, you might want to choose distance 1706 between ribs of 31 inches); and d. Plot out arch member 130 rib locations 1702 within the available distance D along the stringer 110.

Thus, for example, if you have a 12-foot long stringer, L=12', minus 6" (for 3 inches space on each end of the stringer), leaving 11'6" divisible by the number of arch member 130 ribs desired, say 5. Since 12' equals 144", subtracting 6" leaves 138". Dividing 138" by 4 (i.e., 5 ribs −1 rib=4 ribs)=a maximum of 34.5" between each arch member 130 rib location. If per calculations described previously for determining arch member 130 length yields arch members that are 60" long at their longer length portions, this means that the user may select equidistant rib distances of, say, 31" between each rib, and thereby be well within the 34.5" allotted above along the stringer length, which in turn allows for overlapping of stringer ends to continue for longer length structures 100, 100', 100", and further layout for subsequent stringers 110 along the length of an arch structure. In this way, it will be appreciated that very long arch structures 100, 100', 100" may be made.

This method of laying out the construction of an arch structure enables the use of spinning and double-threaded end lag bolts 139 (FIG. 4) to interconnect midpoints 136 of arch members 130 at arch member rib locations 1702 along the stringer 110, since a double-threaded end lag bolt may be screwed into the stringer 110 at the predetermined distances (e.g., every 31", with the first such lag bolt being at least 3" from the end of the stringer member). Further, each arch member 130 may be pre-drilled and spun about its mid-point 136 on each double-threaded end lag bolt 139 without hitting adjacent arch members 130 and lag bolts.

In this way, a less-preferred method of construction comprising toe-nailing (the practice of driving nails or screws midway into a member to interconnect it with another member, often resulting in splitting of members) is avoided, and construction is facilitated and strengthened by easily spinning each arch member midpoint onto a corresponding stringer member, and wherein per the above example, tour courses of arch members 130 may be installed on a stringer member 110, and so on for other stringer members, such that portions of the arch structure 100, 100', 100", chunks of the structure with stringers 110 and arch member 130 ribs extending therefrom, may be brought together and fastened with fasteners 150, 151, as described previously.

This method of construction will greatly enhance the integrity, efficiency, and ease of construction of the resulting structure 100, 100', 100". Further, since the invention in accordance with one or more aspects eliminates the need for toe-nailing, and since there are integrated wall-stud members 170 provided for, together with tensioning members 199, the need for earthquake resistant ties, such as Simpson® brand ties, may possibly be eliminated.

Referring now to FIGS. 7, 8, and 14, in accordance with another embodiment, and one or more aspects of the invention, there is provided an at least partially-domed arch structure 750, 800, 1400, part of the points 701, 703 along a cross-section outline of which defines equidistant points along a plurality of intersecting normal longitudinal (701) and latitudinal (703) radially-arched curves. The at least partially-domed arch structure 750, 800, 1400 comprises: a plurality of elongated rectangular cross-section arch members 130', each of the plurality of arch members having a midpoint 706, first and second side surfaces 708, 710 lying in substantially parallel planes, and first and second angled ends 712, 714 of equal but opposing angular magnitude, the ends of each of the plurality of arch members being shaped to be adapted to completely abut an end of another of the plurality of arch members.

Each of the plurality of arch members 130' has a longest length 716 parallel to a longitudinal length of each arch member and a shortest length 718 parallel to the longitudinal length of each arch member. Each end 712, 714 of each arch member 130' is fully abutted to the degree possible at that angle with a corresponding end 714, 712 such that at each longest length 716 of each of the plurality of arch members 130', where it is abutted to an end of a corresponding arch member so as to be oriented to define equidistant points 701, 703 along the longitudinal and latitudinal radial curves defined along the cross-section outline of the partially-domed structure 750, 800, 1400.

The at least partially-domed arch structure 750, 800, 1400 further comprises a plurality of levels 1, 2, 3, 4, 5, 6 (FIG. 7); 1, 2, 3, 4 (FIG. 8—wherein level 1 is actually comprised of compression header block); and 1, 2, 3, 4, 5 (FIG. 14); of courses of a plurality of elongated rectangular cross-section stringer members 802, each stringer member of each course of the plurality of courses of stringer members being of equal length, each course of stringer members being positioned an increasingly large distance from a central point 803 of the partially-domed arch structure, up to an equatorial inflexion point 806 (e.g., if a more spherical type structure—not shown entirely—is employed), such that increasingly longer stringer members 802 are required to span the entire latitudinal curvature of the arch at each given course level of increasingly larger distance from the central point 803 of the at least partially-domed arch structure up to the equatorial inflexion point (at which point each given course level of stringer members begins to be comprised of increasingly smaller stringer members), and such that each increasingly larger course of stringer members 802 requires increasingly longer stringer members to span the increasingly longer latitudinal arc at each increasingly distant course level from the central point.

In further regard to these levels 1, 2, 3, 4, 5, 6 as mentioned above, it may be further seen in FIG. 8, that there may be provided header stringer members 794 at the uppermost level. These header stringer members are provided as headers, or T-heads, for arch members 130' terminating at such points. This may be advantageous where otherwise there would be too many stepwise, radially-dispersed and angular offset radial arches to fit easily, as such would need to come to a point 803, for example as shown at the top of the structure 800.

Each stringer member 802 comprises first and second opposing compound angled ends (compound as in cut at a certain angle and with a certain bevel as with a miter chop-saw) 804, 805 of equal but opposing angular magnitude, each end of each of the plurality of stringer members being shaped to be adapted to converge crossways on and completely abut a side surface of one of the arch members 130'. Further, each such stringer member 802 has a longest length 807, and a shortest length 809, each length being parallel to the longitudinal length of each stringer member, each end 804, 805 of each longest length of each of the plurality of stringer members 802 being abutted and oriented to define generally equidistant points 703 along the latitudinal radial curves defined along the cross-section outline of the at least partially-domed arch structure 750, 800, 1400. Preferably, each stringer member 802 comprises a compound angle, with equal but opposing acute angles (as to the material remaining on the end of the stringer) being employed as described above and as shown in FIGS. 7, 8 and 14.

These compound opposing equal angles are needed because of the radial nature of the latitudinal and longitudinal lines formed by the structures 750, 800, 1400. Further, the angles are apparent as one traverses from the bottom to the top of the structures 750, 800, and 1400, as well as horizontally around latitudinal arch lines of the structures 750, 800, 1400, it can be seen that an angle of rotated position of each stringer member 802 is rotated upwardly relative to previously lower levels of stringer members and along and according to a longitudinally radially-curved line along which each stringer member is positioned, until the stringer members are almost vertical at their highest levels. Further, it can be seen than an angle of rotated position of each arch member 130' is rotated laterally relative to next previous laterally-positioned arch members 130' and along and according to a latitudinally radially-curved line until opposing arch members on a far side of the at-least-partially-domed arch structure 750, 800, 1400 are rotated 180° relative to those on a near side. As the members 802, 130' are thus positioned, the compound angles referred to previously (i.e., wherein a flat surface on the end of each stringer member 802 is formed by an equally-angular cut on each end, the cut having at least an x-coordinate component and a y-coordinate component, as in a Cartesian Coordinate system) are necessary so that abutting flat ends 804, 805, and 712, 714, abut fully, without any steps or notches, on corresponding side surfaces 708, 710, and 112, 114, respectively. And while the aforementioned cuts are of a compound nature, they are still easily made since they are repetitively applied to virtually all of the stringer members 802 of the at-least-partially-domed structure 750, 800, 1400, thus lending to the kit-type capability nature of the structures in accordance with an aspect of the present invention.

At the bottom of the structure 800 of FIG. 8, there are provided scissor-crossed foundation members 880 where special arch members 882, 884 terminate with fully terminal end surfaces (of the special arch members) abutting and resting on surface members 886 of the scissor-crossed foundation members. As with other embodiments of the invention, these terminal end surface to side surface junctions are preferably reinforced with fasteners. Each special arch member 882, 884 thus has an angled end similar to angled ends of arch members 130', but similar to a wall stud member 170, each special arch member also has an angled end, e.g., such as a squared, or normal, or 90" end, adjusted to fully abut with a base member (e.g., base member 880).

Referring to FIGS. 7 and 8, it can be seen that additional materials may be utilized to strengthen components of the structure, such as multiple layers of arch members may be used to create beam-like arch structures (e.g., as shown at 790 and 792 of FIGS. 7 and 8) for supporting additional loads. These beam-like structures are simply comprised and constructed by combining, for example to create a four-layered arch member 130, 130' of a rib, two doubled and scissored arch members 130, 130', as described previously. Or, alternatively, for example, a three-layered arch member 130, 130' of a rib, may be constructed by alternating scissored arch members 130, 130', with two outer arch members being aligned as shown with a central arch member being scissored with the outer arch members as shown.

There are provided a plurality of fasteners 850 (representative fasteners shown in FIG. 8), such as staples or nails, interconnecting the ends 804, 805 of each stringer member 802 to an arch member 130', and also interconnecting end-to-end, each arch member to a corresponding arch member, to make the arch structure as if monolithic. As with previous embodiments, the arch members 130' may preferably be provided such that each arch member 130' is adapted to span and interconnect every other, non-adjacent, stringer member 802, and further each arch member may likewise be adapted to undergird (as shown at 706) every other stringer member 802, except with this embodiment, the arch members 130' undergird the stringer members at a location where two stringer members abut, as fully as possible, flat end surface (of the stringer member) to flat side surface (of the arch member), opposing side surfaces of adjacent and end-to-end abutting arch members.

Referring specifically to FIG. 7, arch structures 100' (700) and at least partially-domed structures 750 may be combined. In such a case, there is provided a composite structure 700, 750, wherein the arch structure 700 defines a first end opening 780 and a second end opening 782, the arch structure further comprising an at least partially-domed arch structure 750 defining an equally-sized end opening (784) fastened adjacent at least one end opening (i.e., 782 as shown in FIG. 7) of the arch structure. To integrate, or otherwise attach these two openings 782 and 784, wherein a plurality of the arch members 130, 130' of the arch structure further comprise a plurality of arch structure opening arch members, and further comprising a plurality of fasteners (not shown) interconnecting the plurality of domed structure opening arch members to the plurality of arch structure opening arch members, to help, together with other fasteners (e.g., see 850 of FIG. 8) and tensioning members 199 further described below, make the combined arch structure 700 and at least partially-domed arch structure 750 fortified to be as if monolithic.

Figure 9A:
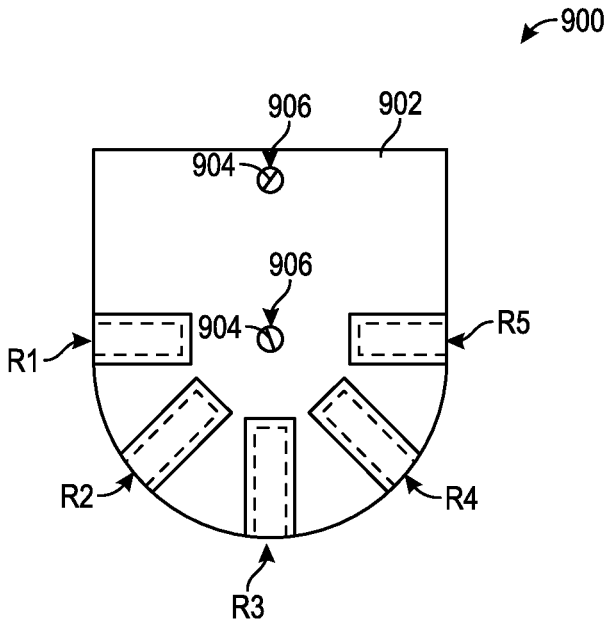
FIG. 9A is a top plan view of a center plate useful in accordance with an embodiment of one or more aspects of the invention for receiving and holding ends of a built structure, such as for example when integrating an at least partially-domed structure with a radial arch structure as shown in FIG. 7.
Figure 9B:
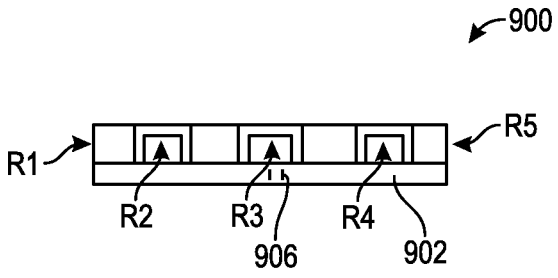
FIG. 9B is a front elevation view of the center plate of FIG. 9A.

Referring to FIGS. 9A and 9B, there is provided a face plate 900 comprising a planar plate 902 with preferably rectangular retaining bays R1, R2, R3, R4, R5 welded to the plate for retaining and fastening first (typically upper) ends 712 of arch members 130' comprising the at least partially-domed structure 750. The face plate 900 maintains the ends 712 properly radially and longitudinally spaced, and interconnects the ends 712 to an uppermost stringer 110 of the arch structure 700 where the plate is fastened to the upper stringer member by a fastening member 904 through a series of holes 906. The face plate 900 helps with rendering the combined structure 700, 750 fortified to be as if monolithic.

The at least partially-domed arch structures 750, 800, 1400 of these embodiments each may further comprise a plurality of tensioning members 199 (as shown in FIG. 7), each tensioning member having first and second ends 201, 202, each end of each tensioning member being fastened to one of an arch member 130' and a stringer member 802. In the case of vertically-oriented tensioning members 199, the bracket 205 of the tensioning member is preferably fastened securely to an arch member 130, 130', each tensioning member extending along a plurality of defined points 701 along a vertically-oriented radial curve defined by the at least partially-domed arch structure.

Still further, the at least partially-domed structure 750, 800, 1400 may also further comprise a plurality of horizontal tensioning members 799 as shown in FIG. 7, each tensioning member of the plurality of tensioning members having first and second ends (like tensioning members 199), each end of each tensioning member being fastened to one of an arch member 130' and a stringer member 802. Unlike tensioning members 199, tensioning members 799 extends horizontally along a plurality of defined points 703 along a latitudinal radial curve defined by the at least partially-domed arch structure, each tensioning member being capable of being tightened such that, together with each fastener 153 being fastened, renders the combined arch structure 700 and at least partially-domed arch structure 750 fortified to be as if monolithic. Thus, it will be appreciated that whereas longitudinally-oriented tensioning members 199 tend to compress arch members 130 of arch structures 100, 100', 100" when tightened, tensioning members 799 tend to compress stringer members 802 of at least partially dome-shaped structures 750, 800, 1400 when tightened.

Each such tensioning member 199, 799 is capable of being tightened as described previously, such that together with each fastener 850 being fastened, the at least partially-domed arch structure 750 (together with arch structure 700 if present), 800, 1400 is made fortified to be as if monolithic, and therefore capable of withstanding, without damage to the structure, sufficient gravitational weight and load-type forces, sufficient side-to-side shifting type forces, and sufficient uplift-type forces, as for example resulting from lifting the structure by a hook adjacent an upper portion of the structure.

Referring further to FIG. 14, and similar to wall stud members 170 of arch structures 100', the at least partial dome structure 1400 gazebo comprises a plurality of bypassing-type extension poles 1402 serving as pillar posts for the dome structure shown. Further, perhaps in lieu of tensioning members 199, there may preferably employed lateral brace members 1404, both for decorative purposes and for further securing the dome of the structure relative to the poles 1402. The gazebo of dome structure 1400 further may optionally comprise foundation members 1480 and even flooring 1482 for a more appealing and functional structure.

Thus, in accordance with one or more of the foregoing aspects and embodiments of the invention relating to an at least partially-dome shaped structure, there are provided a number of structures 750, 800, 1400 that are both appealing visually, are highly functional, and are capable of being constructed of readily-mass-produced, and commonly-available relatively inexpensive materials (such as standard wood stock or aluminum stock), all stock being largely comprised of relatively small stock which is easy to transport and carry (of course depending on the loads anticipated to be borne) and uniformly-sized stock capable of being quickly and easily mass-manufactured at a remote, covered, air-conditioned, location.

Such structures may then be transported as if monolithic, either in whole or in chunks, or portions, to a final construction location in the field. Thus, it will be appreciated that there is now made possible with various aspects of the present invention, the ability to assemble many structures of like kinds with standard materials (pre-cut stringers, arch members, fasteners and tensioning members) as could be provided as part of a kit for assembly on site. As described herein, such a kit of materials would be relatively inexpensive to manufacture, since the materials could be made of standard-sized materials generally without any need for planing or other shaping (other than angle cuts on the ends of arch members) and cutting to length as appropriate for a desired structure.

Figure 18A:
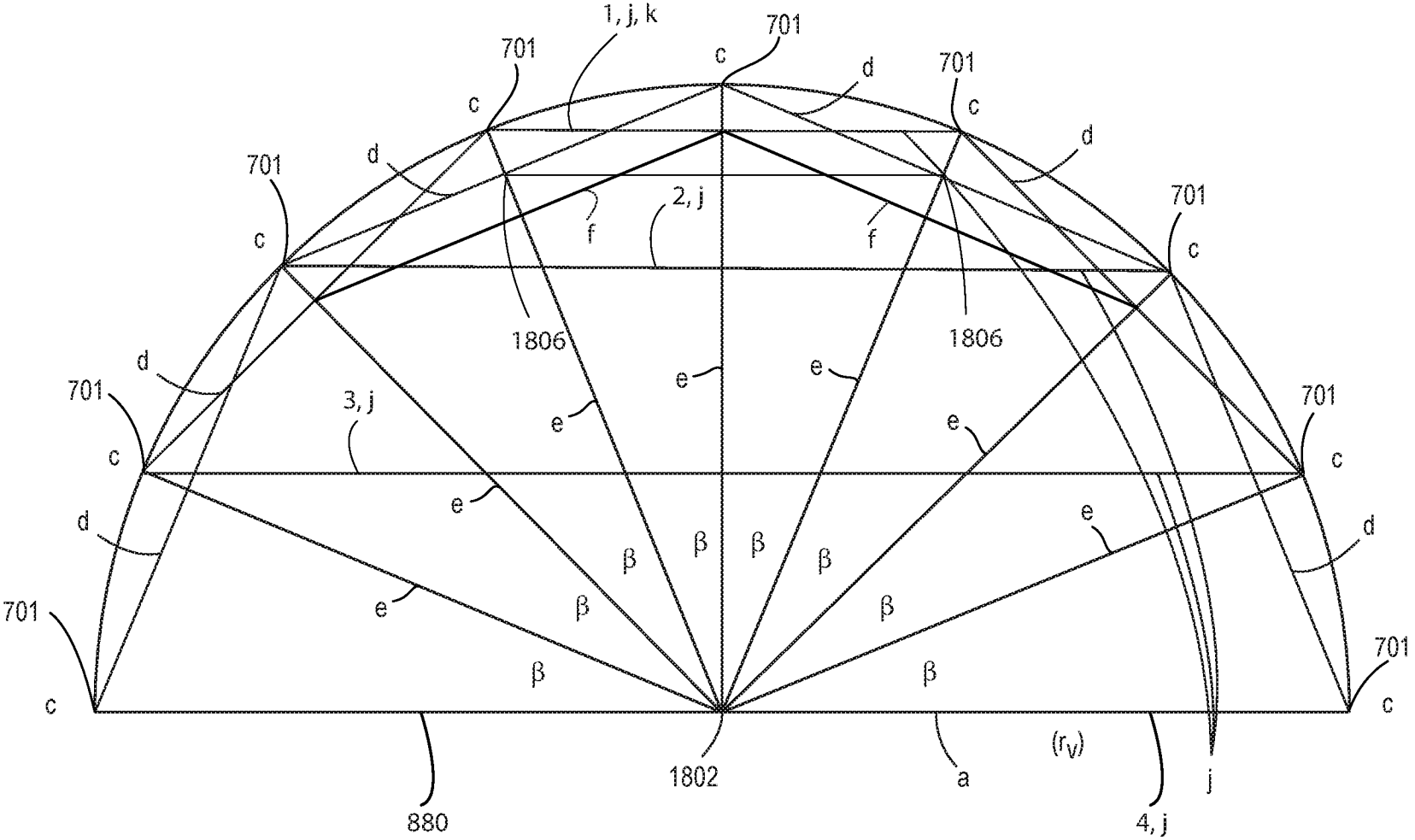
FIG. 18A is a diagram for assisting with explaining the method of laying out and designing an at least partially-domed arch structure according to one or more aspects of the invention.
Figure 18B:
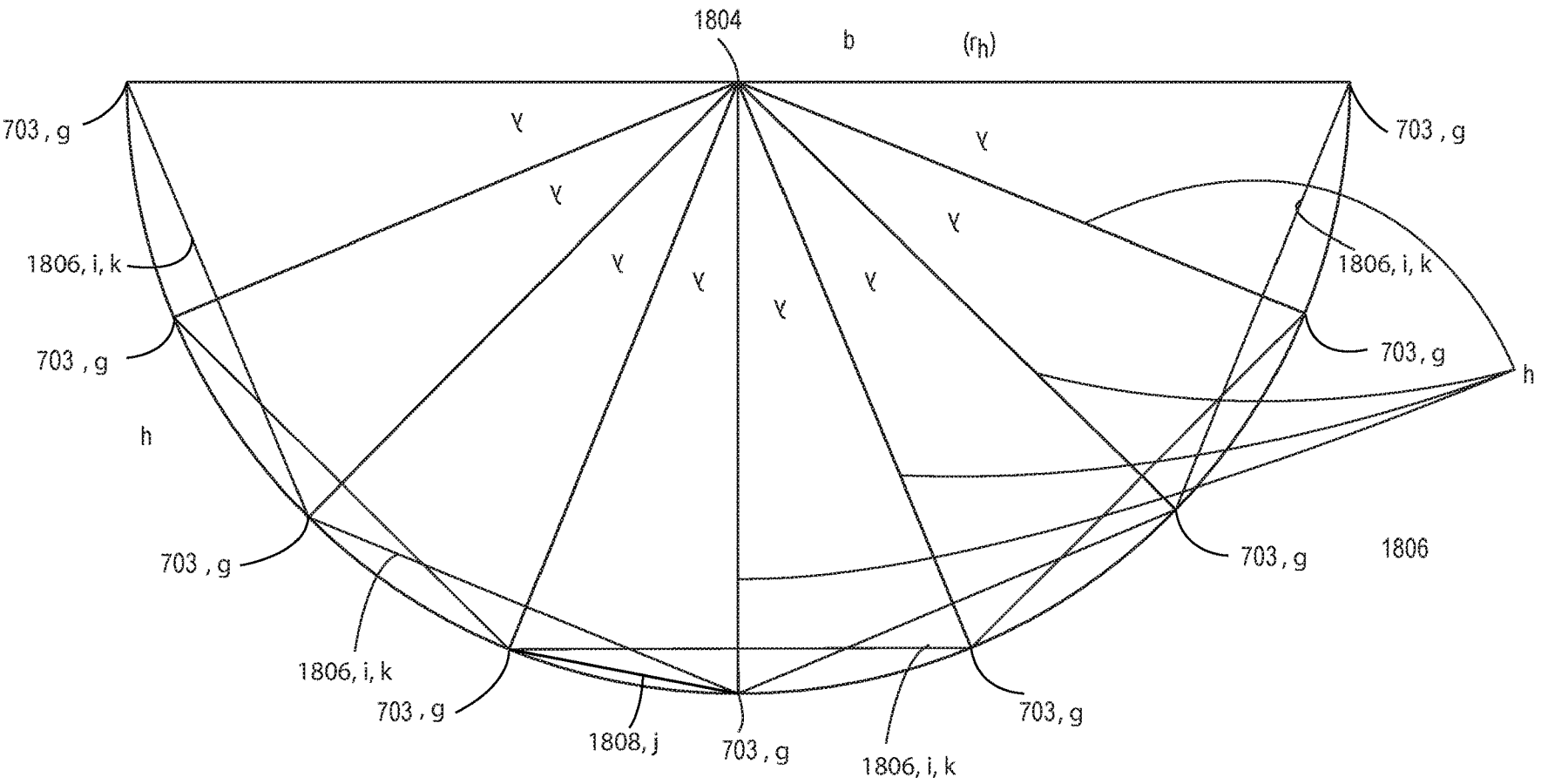
FIG. 18B is another diagram for assisting with explaining the method of laying out and designing at least partially-domed arch structure according to one or more aspects of the invention.

Referring now to FIGS. 8, 14 and 18A-B, there is provided a method of laying out, designing and constructing an at-least partially-domed arch structure 750, 800 with defined longitudinal points 701 and latitudinal paints 703, comprising the steps of:

a. Determine, as shown in FIG. 18A, and draw a semi-circle for a desired vertical longitudinal radius ($r_v$) (and/or diameter ($d_v 2\times r_v$) in the case of an at-least 180-degree structure) of an arch rib comprised of arch members 130'—in the case where the partially-domed structure 750 is to enclose an end of an arch structure 700 as shown in FIG. 7, of course the vertical radius of the at-least partially-domed arch structure will be the same radius as the arch structure radius:

b. Determine, as shown in FIG. 18B, and draw a semi-circle for a desired horizontal latitudinal, equatorial, base radius ($r_h$) and/or diameter ($d=r_h\times 2$) of the base of the at-least partially domed arch structure—this will usually be the same radius as the vertical longitudinal radius ($r_v$) determined in a above, and in the case of enclosure of an end of a radial arch structure as shown in FIG. 7, this radius usually will be the same as the radius of the arch structure—otherwise, a non-uniform horizontal base radii would result in more of an elliptical dome;

c. Divide and plot arc points on the arch of FIG. 18A for the semi-circular dome in preferably evenly-divisible angle β degree increments (e.g., 22.5°, 15°, or 30° degrees) to determine the number of courses of compression block stringers, which stringers are actually pressure blocks as further described herein, wherein these incremental divisions will determine the number of courses of stringers (pressure blocks) for the at-least partially-domed structure. Thus, in the case of 22.5° points as shown in FIG. 18A, there would be 9 points 701, including end points and a top center point, and this would therefore suggest three courses or levels 1, 2, 3 of compression blocks (recalling that the uppermost level 1 is a header compression block level), plus a base members 880 course (similar to a normal non-compression block type stringer), and a center point, wherein the number of points (9) equals 2× the number of courses (including the base members 880 course) plus the center point:

d. Continue the layout and design of the at-least-partial dome-shaped arch structure by connecting every other point on the vertical semi-circle of FIG. 18A with chords. These chords will determine uniform outer lengths for each arch member component and also define generally the height of stock materials able to be used without extending the structure between arc-type natural constraints;

e. Draw radial lines from the center point 1802 to each point 701. This step will further help to determine where to locate compression block stringer member and arch member intersections and to determine arch members 130' widths;

f. Draw in the width of a first arch member component, for example as shown at between 90° and 45° and between 90° and 135° on FIG. 18A. The inner length is determined by interconnecting points 1806 defined by the intersecting radial lines drawn in step e and the chords drawn in step d. As can be readily seen in FIG. 8, for each arch member of each longitudinally-extending arch member rib of the at-least-partially-domed structure 800, there are required preferably three arch member components 130', two outer components which are half the thickness dimension of an inner component, the inner component being partially sandwiched between the two outer components. As shown in FIG. 8, these components 130' are in scissor-crossing relationship such that at every other course of compression block stringer members 802, the inner component 130' protrudes beyond the other two outer components, and further such that at intermediate compression stringer member locations to the aforementioned every other course of compression block stringer members, the two outer arch member components protrude. Each arch member component 130' fully abuts end-to-end with another adjacent arch member component, outer components abutting each other, and inner components abutting each other. Once the needed size for arch member components 130' is determined in accordance with the current method, the arch member components may be cut to size and fixed end to end laying on the ground and before raising the same into the dome structure. It will be appreciated that the same length of arch members 130' may be used for both inner and outer arch members 130', though thinner material may be used for the outer arch members 130'.

g. Once the outer length of each arch member is determined (as the chord length between non-adjacent radial points on the semi-circle), and each arch member rib is created as described above, fastening arch member rib components end-to-end and with scissor-relationships between components of each arch member being formed with the arch members lying on the ground and as shown, compression block type stringer members are next created by plotting points 703 at equally-divisible radial angles γ (e.g., at 22.5°) according to the semi-circle determined in step b., and as shown in FIG. 18B.

h. Draw radial lines between center point 1804 and each point 703. Since the outermost semi-circle on FIG. 18B is the equatorial course of stringer members, these stringer members are not compression block type stringer members, but rather in the case of a semi-spherical dome shaped arch structure with 180° vertical circumference, the lowermost course of stringer members 880, or the base of the dome, is preferably formed as a combination plate member. This may be accomplished by cutting stock to butt end-to-end and so as to be wide enough to provide a surface on which ends of scissored arch members 130' can abut, similarly as they do and as described in connection with end stringer member 120 of FIG. 1, Alternatively, as shown in FIG. 8, these base stringer members may be scissored themselves and arranged to receive abutting arch members ends as shown and described previously.

i. After radial lines are drawn per step h., the length of each chord e.g., chord 1806, may be determined by the formula, 2Radius* Sin (γ)/2. Alternatively, the chord 1806 may be determined by the formula 2*SqRt of $r^2$-$d^2$, where d=the perpendicular distance between the center of the circle bisecting the chord. In the present case, if the radius is 10 feet, and γ=22.5, the chord is 3.9 feet (corresponding to the outer length of the stringer member at that bottom course). As can be seen in FIG. 8, the bottom course of stringer members 880 are each terminated at ends corresponding with alternate ribs of arch members 130'.

j. Thereafter, the outer length of each subsequently higher level course (in the case of circular, not elliptical, radii for both the latitudinal and longitudinal arcs of the structure) is determined on a circle with diameter equal to each chord at a planar course level through each next highest point 701 determined in step c. as shown in FIG. 18A, wherein the diameter j of the circle at each next highest point 701=2*Radius* Sin (γ)/2. Then, once the diameter j is thus determined, the length of chord 1808 may be determined as an outer length of each compression block stringer member 802 (FIG. 18B) may be determined by calculating the length of each chord subtended by internal angles γ between radial points 703 identified in step g. above, minus the thickness of the arch member(s) to which the compression block abuts (whether a central full-thickness arch member component, or a two outer half-thickness arch member components plus a central full-thickness arch member, it being the case that in those locations, as can be seen at 806 in FIG. 8, where a compression block abuts outer arch member components, a shim, or a compression member 806 of the same thickness as an inner arch member 130' is installed between the two outer arch member components. In this way, each compression block stringer 802 has a sturdy arch member 130', or arch members plus shim compression member 806 combination 130', 806 to press against when the structure is complete. Further, fasteners 850 may be advantageously installed through each compression block and each arch member to which it is to be fastened. Further, it will be appreciated that the number of arch member components to which the compression block abuts is either 3, or 1, and which it is, 3 or 1 such arch member components, alternates with every course of the compression blocks 130'. The shim, or compression member, 806 facilitates fastening of arch member 130' ribs end to end, since it provides a means of enabling driving of a screw, nail, or staple, through the ends of the arch members and into the overlapping shim, or compression member, 806.

k. As can be seen in FIG. 8, an extra header member compression block 794 may be installed in like fashion to prevent excess crowding of arch members as they approach the center 803 of the structure. Since such a header member compression block 794 spans two radial ribs of arch members 130', it will be appreciate that the length of the header member compression block 794 may be determined by the formula of step i. above applied at a radius of course, or level, 1 figured per step j. of FIG. 18A, minus the thickness of two outer arch members 130' and one inner arch member 130'. And again, fasteners 850 may be used between the ends of each arch member component and such header member compression blocks, as well as between compression block stringer members and arch member components, as well s between arch member components and the base stringer members 886.

l. Determine locations for attaching post-tensioning so as to be fixed at lower portions of the structure and so as to run along points 101 in order to create multi-directional static compressive forces at least partially terminating at abutting locations between stringer members and arch members (i.e., along arch members or stringer members oriented to approximate a radial arch curved surface) and to distribute such forces (compressive and tensile) appropriately throughout the structure to render it fortified to be as if monolithic. Thus, as shown in FIG. 7, tensioning members 199 may be used to run from the base to the top of the structure, and around the structure as well horizontally. In this way, the at-least-partially dome-shaped arch structure may be fastened and tensioned so as to be rendered fortified to be as if monolithic.

Further, with the foregoing aspects of the invention, there are provided a number of different alternatives for mixing and matching of structures, fasteners, and tensioning systems, all without departing from the true scope of the invention as claimed. Thus, it will be appreciated by those skilled in the art that there are various possible combinations of the above-described elements and sub-elements for various embodiments of the invention, whether such elements and sub-elements be combined in whole or in part, which may be employed without departing from the scope and spirit of the invention as claimed.

While a preferred embodiment of the present invention has been shown and described, it will be apparent to those skilled in the art that many changes and modifications may be made without departing from the invention in its broader aspects. For example, it will be appreciated that one of ordinary skill in the art may mix and match the various components of the various embodiments of the invention without departing from the true spirit of the invention as claimed. Thus, by way of example, it will be appreciated that one or more fastening means may be employed with different types of materials to create monolithic structures in accordance with one or more aspects or embodiments of the invention. Likewise, it will be appreciated that one or more post-tensioning means may be used with one or more embodiments of the invention. Further, it will be appreciated that additional materials may be utilized to strengthen components of the invention, such as multiple layers of arch members may be used to create beam-like arch structures (e.g., as shown at 790 and 792 of FIGS. 7 and 8) for supporting additional loads, and stringer members may be elongated by overlapping ends of adjacent stringers to make a longer structure than would otherwise be the case, all without departing from the broader aspects of the invention as claimed. The appended claims are therefore intended to cover all such changes and modifications as fall within the true spirit and scope of the invention.

I claim:

1. An arch structure defining equidistant points along a radial curve, comprising:

a plurality of elongated rectangular cross-section stringer members, each stringer member of said plurality of stringer members comprising opposing first and second side surfaces lying in substantially parallel planes;

a plurality of elongated rectangular cross-section arch members, each of said plurality of arch members having a midpoint and first and second angled ends of equal but opposing to one another angular magnitude, the ends of each of said plurality of arch members completely abutting without any step or notch in any said arch member or any said stringer member a side surface of two non-adjacently positioned of said plurality of stringer members, each of said plurality of arch members undergirding a one of said plurality of stringer members located between two non-adjacently positioned stringer members at the mid-point of each of the plurality of arch members, each of said plurality of arch members being oriented in crossing relationship to another of said plurality of arch members;

a plurality of fasteners interconnecting at least one end of each said arch member abutted to a stringer member.

2. The arch structure of claim 1, wherein the equidistant points along the radial curve form an incomplete circle, further comprising a plurality of end stringer members, and wherein each of said plurality of stringer members other than said plurality of end stringer members is an intermediate stringer member, each said end stringer member positioned crossways of said arch members at outermost extents of the arc of the incomplete circle, further comprising a plurality of end arch members, and wherein each of said plurality of arch members other than said plurality of end arch members is an intermediate arch member, each of said plurality of end arch members having a first end and a second end, the first end of each of said plurality of end arch members completely abutting one of said plurality of intermediate stringer members, the second end of each of said plurality of end arch members completely abutting a side surface of one of said plurality of end stringer members or bypassing one of said plurality of end stringer members, each of said plurality of end arch members further being oriented in crossing relationship to another of said plurality of end arch members.

3. The arch structure of claim 2, wherein said plurality of end stringer members comprises two end stringer members of wider width for capping the arch structure, each said end stringer member being positioned at ultimate extent locations on the defined radial curve, further comprising a plurality of special arch members, each said special arch member having a first end and a second end, wherein each of the second ends of each of said plurality of end arch members comprises an opposing angle of equal angular magnitude to the first end of each of said plurality of end arch members, the second end of each of said plurality of end arch members completely abutting a side surface of one of said plurality of end stringer members, and wherein the first end of each of said plurality of special arch members completely abuts one of said plurality of intermediate stringer members, the second end of each of said plurality of special arch members completely abutting a side surface of one of said plurality of end stringer members, each of said plurality of end arch members and said plurality of special arch members further being oriented in crossing relationship to another of said plurality of end arch members and said plurality of special arch members.

4. The arch structure of claim 3, wherein the arch structure forms a structure for a subway slip form.

5. The arch structure of claim 3, further comprising at least one tensioning member of the post-tensioning type applied after the structure is fastened together with fasteners to compress said plurality of arch members onto completely-abutted stringer members, without any step or notch in any said arch member or any said stringer member, each said at least one tensioning member having first and second ends, each end of each said at least one tensioning member being fastened to one of one of said end stringer members, one of said end arch members, and one of said special arch members, each said at least one tensioning member extending along the equidistant points along the radial curve defined by the arch structure.

6. The arch structure of claim 5, wherein the arch structure forms a structure for a subway slip form.

7. The arch structure of claim 2, wherein the second end of each said end arch member bypassing one of said plurality of end stringer members further comprises an integral elongated wall stud member, the arch structure further comprising at least one foundation member, the first end of each said wall stud member abutting the next adjacent intermediate stringer member, and the second end of each said at least one wall stud member being connected to said at least one foundation member.

8. The arch structure of claim 2, wherein the arch structure forms a frame structure for one of a sun shade, a barracks structure, and an arched trellis arbor.

9. The arch structure of claim 2, further comprising at least one tensioning member of the post-tensioning type applied after the structure is fastened together with fasteners to compress said plurality of arch members onto stringer members to which each of the plurality of arch members is completely abutting without any step or notch in any said arch member or any said stringer member, each said at least one tensioning member having first and second ends, each end of each said at least one tensioning member being fastened to one of one of said end stringer members, one of said arch members, and one of said end arch members, each said at least one tensioning member extending along equidistant points along the radial curve defined by the arch structure.

10. The arch structure of claim 9, wherein the arch structure forms a frame structure for one of a sun shade, a barracks structure, and an arched trellis number.

11. The arch structure of claim 1, further comprising at least one tensioning member of a post-tensioning type applied after the structure is fastened together with fasteners to compress said plurality of arch members onto completely-abutted stringer members, without any step or notch in any said arch member or any said stringer member, each said at least one tensioning member having first and second ends, each end of each said at least one tensioning member being fastened to one of one of said stringer members and one of said arch members, each said at least one tensioning member extending along the equidistant points along the radial curve defined by the arch structure.

12. The arch structure of claim 1, further comprising another fastener interconnecting each of said plurality of arch members to another of said plurality of arch members at a crossing location of the each of said plurality of arch members to the another of said plurality of arch members.

* * * * *